US011402150B2

(12) United States Patent
Choi et al.

(10) Patent No.: US 11,402,150 B2
(45) Date of Patent: Aug. 2, 2022

(54) REFRIGERATOR AND CONTROL METHOD THEREFOR

(71) Applicant: LG ELECTRONICS INC., Seoul (KR)

(72) Inventors: Kwang Hyun Choi, Seoul (KR); Chang Won Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 285 days.

(21) Appl. No.: 16/585,284

(22) Filed: Sep. 27, 2019

(65) Prior Publication Data

US 2021/0018259 A1 Jan. 21, 2021

(30) Foreign Application Priority Data

Jul. 15, 2019 (KR) ..... 10-2019-0085199

(51) Int. Cl.
*F25D 25/02* (2006.01)
*F25D 11/02* (2006.01)
*F25D 29/00* (2006.01)

(52) U.S. Cl.
CPC ..... *F25D 25/025* (2013.01); *F25D 11/02* (2013.01); *F25D 25/021* (2013.01); *F25D 29/003* (2013.01); *F25D 29/00* (2013.01); *F25D 2700/02* (2013.01)

(58) Field of Classification Search
CPC .... F25D 2700/02; F25D 29/00; F25D 25/025; F25D 25/021; A47B 88/453; A47B 88/90; A47B 2088/901; A47B 2210/175
See application file for complete search history.

(56) References Cited

U.S. PATENT DOCUMENTS

| | | | |
|---|---|---|---|
| 658,999 | A | 10/1900 | Scannel |
| 1,067,404 | A | 7/1913 | Callaghan |
| 2,072,244 | A | 3/1937 | Coursen |
| 2,679,658 | A | 6/1954 | McCormick |
| 2,731,318 | A | 1/1956 | Hoff |

(Continued)

FOREIGN PATENT DOCUMENTS

| | | |
|---|---|---|
| CN | 100417900 | 9/2008 |
| CN | 101981397 | 2/2011 |

(Continued)

OTHER PUBLICATIONS

European Search Report dated Mar. 23, 2020 issued in EP Application No. 19199602.4.

(Continued)

*Primary Examiner* — Lionel Nouketcha
(74) *Attorney, Agent, or Firm* — KED & Associates LLP

(57) ABSTRACT

The present disclosure relates to a refrigerator and a control method therefor. A refrigerator may include: a cabinet; a drawer provided to move in and out of the lower storage space and opening and closing the lower storage space; a lifting unit provided inside the drawer and elevated up and down; an opening/closing motor providing power for opening and closing the drawer; a lifting motor connected to the lifting unit and providing power for elevating the lifting unit; and a controller to reopen the drawer when the closing of the drawer is detected while the lifting unit is being elevated or the elevation of the lifting unit is completed.

17 Claims, 23 Drawing Sheets

(56) References Cited

U.S. PATENT DOCUMENTS

| | | | | |
|---|---|---|---|---|
| 4,545,628 | A | 10/1985 | Richey | |
| 5,253,488 | A | 10/1993 | Kim et al. | |
| 6,044,606 | A | 4/2000 | Hamar | |
| 6,109,774 | A | 8/2000 | Holmes et al. | |
| 6,371,584 | B1 | 4/2002 | Alreck | |
| 6,722,749 | B1 | 4/2004 | Pagac | |
| 7,600,829 | B2 | 10/2009 | Oh et al. | |
| 7,600,830 | B2 | 10/2009 | Oh et al. | |
| 7,600,833 | B2 | 10/2009 | Oh et al. | |
| 7,690,586 | B2 | 4/2010 | Kang | |
| 8,282,177 | B1 | 10/2012 | Rotter | |
| 8,360,539 | B2 | 1/2013 | Brown et al. | |
| 8,376,481 | B2 | 2/2013 | Lee | |
| 8,497,644 | B2 * | 7/2013 | Eom | A47B 88/457 318/264 |
| 8,668,289 | B2 | 3/2014 | Lee et al. | |
| 8,794,722 | B2 | 8/2014 | Nuss et al. | |
| 8,844,110 | B2 | 9/2014 | Rotter | |
| 8,864,249 | B2 | 10/2014 | Nam et al. | |
| 9,107,494 | B2 | 8/2015 | Scheuring et al. | |
| 9,377,238 | B2 * | 6/2016 | Hall | F25D 25/025 |
| 9,523,533 | B2 | 12/2016 | Nam et al. | |
| 9,982,937 | B2 | 5/2018 | Tierney et al. | |
| 10,234,195 | B2 | 3/2019 | Yasaka et al. | |
| 10,465,970 | B1 | 11/2019 | Kang et al. | |
| 10,598,428 | B2 | 3/2020 | Kim | |
| 10,690,401 | B2 | 6/2020 | Yang et al. | |
| 10,712,083 | B1 | 7/2020 | Choi | |
| 10,767,920 | B1 | 9/2020 | Choi | |
| 10,786,080 | B1 | 9/2020 | Stravitz et al. | |
| 10,876,788 | B2 | 12/2020 | Choi | |
| 10,932,568 | B2 | 3/2021 | Subrahmanya et al. | |
| 10,939,758 | B2 | 3/2021 | Kim | |
| 11,033,104 | B2 | 6/2021 | Kim | |
| 11,047,619 | B2 | 6/2021 | Choi | |
| 11,131,500 | B2 | 9/2021 | Kim | |
| 2003/0201700 | A1 | 10/2003 | Cho | |
| 2004/0031705 | A1 | 2/2004 | Detemple, II et al. | |
| 2004/0046488 | A1 | 3/2004 | Hogan | |
| 2004/0056573 | A1 | 3/2004 | Chae | |
| 2006/0042306 | A1 | 3/2006 | Choi et al. | |
| 2006/0087207 | A1 | 4/2006 | Oh et al. | |
| 2006/0087208 | A1 | 4/2006 | Oh et al. | |
| 2006/0207283 | A1 | 9/2006 | Kim et al. | |
| 2006/0248916 | A1 | 11/2006 | Kim et al. | |
| 2006/0250062 | A1 | 11/2006 | Janda et al. | |
| 2007/0262686 | A1 | 11/2007 | Ji | |
| 2008/0018215 | A1 | 1/2008 | Carden et al. | |
| 2009/0045713 | A1 | 2/2009 | Kunkle et al. | |
| 2009/0160298 | A1 | 6/2009 | Chen et al. | |
| 2009/0167131 | A1 | 7/2009 | Oh et al. | |
| 2009/0277210 | A1 | 11/2009 | Eveland et al. | |
| 2010/0192621 | A1 | 8/2010 | Kim | |
| 2010/0236279 | A1 | 9/2010 | Eom et al. | |
| 2010/0239795 | A1 | 9/2010 | Gat | |
| 2010/0283365 | A1 | 11/2010 | Chen | |
| 2011/0005264 | A1 | 1/2011 | Lee et al. | |
| 2011/0006656 | A1 | 1/2011 | Nam et al. | |
| 2011/0050065 | A1 | 3/2011 | Lee et al. | |
| 2011/0050066 | A1 | 3/2011 | Lee et al. | |
| 2011/0146333 | A1 | 6/2011 | Koo et al. | |
| 2011/0162402 | A1 | 7/2011 | Park | |
| 2011/0181163 | A1 | 7/2011 | Han et al. | |
| 2011/0210655 | A1 | 9/2011 | Brown et al. | |
| 2012/0091872 | A1 | 4/2012 | Matthes et al. | |
| 2012/0125035 | A1 | 5/2012 | Chellappan et al. | |
| 2012/0306338 | A1 | 12/2012 | Nagahata et al. | |
| 2013/0055543 | A1 | 3/2013 | Rotter | |
| 2013/0129267 | A1 | 5/2013 | Chen | |
| 2013/0145972 | A1 | 6/2013 | Knox et al. | |
| 2013/0264928 | A1 | 10/2013 | Hong et al. | |
| 2013/0270986 | A1 | 10/2013 | Min et al. | |
| 2013/0270987 | A1 | 10/2013 | Kelly | |
| 2013/0270989 | A1 | 10/2013 | Park et al. | |
| 2014/0191646 | A1 | 7/2014 | Nuss et al. | |
| 2014/0265783 | A1 | 9/2014 | Hauer et al. | |
| 2014/0265797 | A1 | 9/2014 | Scheuring et al. | |
| 2014/0265806 | A1 | 9/2014 | Hall et al. | |
| 2014/0319990 | A1 | 10/2014 | Gephart et al. | |
| 2015/0059398 | A1 | 3/2015 | Yoo et al. | |
| 2015/0059399 | A1 | 3/2015 | Hwang et al. | |
| 2015/0069899 | A1 | 3/2015 | Han et al. | |
| 2015/0184918 | A1 | 7/2015 | Klingshirn et al. | |
| 2016/0146533 | A1 | 5/2016 | Jung | |
| 2016/0153704 | A1 | 6/2016 | Burke et al. | |
| 2016/0178274 | A1 | 6/2016 | Shin | |
| 2016/0265816 | A1 | 9/2016 | Gillette et al. | |
| 2016/0305705 | A1 | 10/2016 | Dubina et al. | |
| 2016/0320118 | A1 | 11/2016 | Millett | |
| 2016/0370063 | A1 | 12/2016 | Yang | |
| 2017/0024946 | A1 | 1/2017 | Hashemi et al. | |
| 2017/0051967 | A1 | 2/2017 | Tierney et al. | |
| 2017/0122651 | A1 | 5/2017 | Cizik et al. | |
| 2017/0227279 | A1 | 8/2017 | Yang et al. | |
| 2017/0336129 | A1 | 11/2017 | Cunningham | |
| 2017/0362864 | A1 | 12/2017 | Fazi et al. | |
| 2018/0128540 | A1 | 5/2018 | Yasaka et al. | |
| 2018/0283771 | A1 | 10/2018 | Shin et al. | |
| 2018/0291669 | A1 | 10/2018 | Kim et al. | |
| 2018/0356148 | A1 | 12/2018 | Fei et al. | |
| 2019/0219324 | A1 | 7/2019 | Kang | |
| 2019/0242640 | A1 | 8/2019 | Minoru et al. | |
| 2019/0292831 | A1 | 9/2019 | Choi | |
| 2019/0293341 | A1 | 9/2019 | Yeom | |
| 2019/0323763 | A1 | 10/2019 | Kang | |
| 2019/0346199 | A1 | 11/2019 | Choi | |
| 2019/0390895 | A1 | 12/2019 | Choi | |
| 2020/0011593 | A1 | 1/2020 | Ji | |
| 2020/0069056 | A1 | 3/2020 | Kim | |
| 2020/0072533 | A1 | 3/2020 | Cho | |
| 2020/0072540 | A1 | 3/2020 | Kim | |
| 2020/0072542 | A1 | 3/2020 | Kim | |
| 2021/0003337 | A1 | 1/2021 | Voltarelli et al. | |
| 2021/0259416 | A1 | 8/2021 | Kim | |

FOREIGN PATENT DOCUMENTS

| | | |
|---|---|---|
| CN | 102226626 | 10/2011 |
| CN | 202254607 | 5/2012 |
| CN | 204902419 | 12/2015 |
| CN | 107388718 | 11/2017 |
| CN | 109028726 | 12/2018 |
| CN | 208640001 | 3/2019 |
| CN | 109690213 | 4/2019 |
| CN | 208736030 | 4/2019 |
| CN | 109838961 | 6/2019 |
| CN | 109990557 | 7/2019 |
| CN | 110873500 | 3/2020 |
| DE | 29620152 | 4/1997 |
| DE | 10-2005-016418 | 11/2005 |
| EP | 1 724 540 | 11/2006 |
| EP | 2 299 215 | 3/2011 |
| EP | 2 752 632 | 7/2014 |
| EP | 3 023 721 | 5/2016 |
| EP | 3 505 854 | 7/2019 |
| EP | 3 546 862 | 10/2019 |
| EP | 3 617 630 | 3/2020 |
| GB | 2108564 | 5/1983 |
| JP | H 04-138337 | 12/1992 |
| JP | H 07-275049 | 10/1995 |
| JP | H 08-303944 | 11/1996 |
| JP | 2001-280824 | 10/2001 |
| JP | 2002-264943 | 9/2002 |
| KR | 10-2006-0025806 | 3/2006 |
| KR | 10-2006-0027592 | 3/2006 |
| KR | 10-2006-0053420 | 5/2006 |
| KR | 10-2007-0075671 | 7/2007 |
| KR | 10-2008-0101335 | 11/2008 |
| KR | 10-2009-0027111 | 3/2009 |
| KR | 10-2009-0027112 | 3/2009 |
| KR | 10-2009-0102576 | 9/2009 |
| KR | 10-2009-0102577 | 9/2009 |
| KR | 10-0921380 | 10/2009 |
| KR | 10-2009-0114265 | 11/2009 |

(56) References Cited

FOREIGN PATENT DOCUMENTS

| | | |
|---|---|---|
| KR | 10-2010-0012544 | 2/2010 |
| KR | 10-0946784 | 3/2010 |
| KR | 10-2010-0078916 | 7/2010 |
| KR | 10-2011-0015331 | 2/2011 |
| KR | 20-0460442 | 6/2012 |
| KR | 10-2013-0071919 | 7/2013 |
| KR | 10-2014-0037474 | 3/2014 |
| KR | 10-2018-0138083 | 12/2018 |
| KR | 10-2018-0138085 | 12/2018 |
| KR | 10-2019-0081331 | 7/2019 |
| WO | 92/14522 | 9/1992 |
| WO | WO 03/016661 | 2/2003 |
| WO | WO 2018/051963 | 3/2018 |
| WO | WO 2019/242234 | 12/2019 |

OTHER PUBLICATIONS

European Search Report dated Mar. 12, 2020 issued in Application No. 19199586.9.
European Search Report dated Mar. 17, 2020 issued in Application No. 19199553.9.
European Search Report dated Mar. 20, 2020 issued in Application No. 19199569.5.
European Search Report dated Mar. 30, 2020 issued in Application No. 19199556.2.
European Search Report dated Apr. 3, 2020 issued in Application No. 19199625.5.
European Search Report dated Apr. 6, 2020 issued in Application No. 19199587.7.
European Search Report dated Apr. 6, 2020 issued in Application No. 19199629.7.
European Search Report dated Apr. 7, 2020 issued in Application No. 19199607.3.
U.S. Appl. No. 16/582,831, filed Sep. 25, 2019.
U.S. Appl. No. 16/585,301, filed Sep. 27, 2019.
United States Office Action dated Nov. 19, 2020 issued in co-pending related U.S. Appl. No. 16/582,831.
European Search Report dated Aug. 14, 2020 issued in EP Application No. 19199647.9.
United States Office Action dated Mar. 4, 2020 issued in U.S. Appl. No. 16/582,712.
United States Office Action dated Mar. 9, 2020 issued in U.S. Appl. No. 16/582,810.
European Office Action dated Sep. 30, 2020 issued in EP Application No. 19199556.2.
Chinese Office Action dated Aug. 24, 2021 issued in CN Application No. 201910911796.9.
Chinese Office Action dated Sep. 8, 2021 issued in CN Application No. 201910857458.1.
Chinese Office Action dated Sep. 14, 2021 issued in CN Application No. 201910905166.0.
United States Office Action dated Oct. 15, 2021 issued in co-pending related U.S. Appl. No. 16/582,755.
European Office Action dated Sep. 1, 2021 issued in EP Application No. 19199607.3.
European Communication dated Feb. 8, 2021 issued in EP Application No. 19199627.1.
U.S. Appl. No. 16/582,712, filed Sep. 25, 2019.
European Search Report dated Apr. 1, 2020 issued in EP Application No. 19199637.0.
Chinese Office Action dated Aug. 20, 2021 issued in CN Application No. 201910857469.X.
Chinese Office Action dated Aug. 25, 2021 issued in CN Application No. 201910911807.3.
Chinese Office Action dated Sep. 2, 2021 issued in CN Application No. 201910871084.9.
Chinese Office Action dated Sep. 17, 2021 issued in CN Application No. 201910905094.X.
United States Office Action dated Oct. 6, 2021 issued in co-pending related U.S. Appl. No. 16/583,726.
United States Office Action dated Oct. 6, 2021 issued in co-pending related U.S. Appl. No. 16/582,647.
United States Office Action dated Oct. 6, 2021 issued in co-pending related U.S. Appl. No. 16/582,668.
Chinese Office Action dated Sep. 3, 2021 issued in CN Application No. 201910905106.9.
U.S. Appl. No. 16/582,810, filed Sep. 25, 2019.
United States Office Action dated Jan. 31, 2022 issued in co-pending related U.S. Appl. No. 16/582,756.
United States Office Action dated Feb. 2, 2022 issued in co-pending related U.S. Appl. No. 16/582,605.
GE (Refrigerator Freezer Door Pops Open, http://products.geapplicances.com/applicance/gea-support-search-content?contentId=16979) (Year: 2015).
U.S. Office Action dated Apr. 11, 2022 issued in co-pending related U.S. Appl. No. 16/585,301.
U.S. Appl. No. 16/583,726, filed Sep. 26, 2019.
U.S. Appl. No. 16/582,647, filed Sep. 25, 2019.
U.S. Appl. No. 16/582,518, filed Sep. 25, 2019.
U.S. Appl. No. 16/582,605, filed Sep. 25, 2019.
U.S. Appl. No. 16/582,756, filed Sep. 25, 2019.
U.S. Appl. No. 16/582,668, filed Sep. 25, 2019.
U.S. Appl. No. 16/582,755, filed Sep. 25, 2019.
U.S. Appl. No. 16/585,284, filed Sep. 27, 2019.
U.S. Appl. No. 16/585,30, filed Sep. 27, 2019.
U.S. Appl. No. 16/585,816, filed Sep. 27, 2019.
U.S. Notice of Allowance dated Feb. 23, 2022 issued in co-pending related U.S. Appl. No. 16/582,518.

* cited by examiner

REFRIGERATOR AND CONTROL METHOD THEREFOR

CROSS-REFERENCE TO RELATED APPLICATION(S)

The present application claims priority to Korean Patent Application No. 10-2019-0085199, filed Jul. 15, 2019 in Korea, the entire content of which is incorporated herein by this reference.

BACKGROUND

1. Field

The present disclosure relates to a refrigerator and a control method therefor.

2. Background

A refrigerator is a home appliance that keeps food at low temperatures in a storage space therein sealed by doors. A refrigerator is configured to be able to keep stored food in an optimal state by cooling the storage space using cold air produced by heat exchange with a refrigerant circulating in a refrigeration cycle.

Refrigerators have become larger and multifunctional according to trend of changes in dietary life and high quality of products, and refrigerators having various structures and convenience devices considering convenience of users and allowing efficient use of inner spaces have been released.

The storage space of the refrigerator is opened and closed by a door. Refrigerators are classified into various types according to an arrangement of storage spaces and a structure of doors opening and closing the storage spaces.

Refrigerators may be classified into a swinging-type refrigerator in which a storage space is opened and closed by swinging of a swinging door and a drawer-type refrigerator in which a drawer is opened and closed as a drawer works.

The drawer may be disposed in a lower portion of the refrigerator. In an example where the drawer being disposed in the lower portion of the refrigerator, it is inconvenient to pull a front panel of the drawer because a user may need to bend over from an appropriate distance away to pull out the drawer.

Various refrigerators made to automatically open drawers have been researched and developed. Korean Patent Application Publication No. 10-2009-0102577, Korean Patent Application Publication No. 10-2009-0102576, Korean Patent Publication No. 10-2013-0071919, Korean Patent Application Publication No. 10-2018-0138083, etc., the subject matters of which are incorporated herein by reference, may disclose such refrigerators.

In an example of the drawer being disposed in the lower portion of the refrigerator, a user may need to bend over to take out a basket or food stored inside the drawer. When the basket or food is heavy, it may cause inconvenience or injury.

In order to solve this problem, various structures in which a drawer is raised have been developed.

U.S. Pat. No. 9,377,238, the subject matter of which is incorporated herein by reference, discloses a refrigerator provided with a lifting mechanism for raising and lowering a storage bin (or storage room) provided in a refrigerator compartment.

However, when a lower bin drawer is opened and thus the storage bin is raised by the lifting mechanism, the storage bin may collide with an upper door when the lower bin drawer is closed.

For example, if a user manually pushes the lower bin drawer while using the storage bin, the storage bin may collide with the upper door.

Even if braking is applied to the lower bin drawer, the lower bin drawer can not be closed due to the braking when a user forcibly pushes the lower bin drawer to close the lower bin drawer. Accordingly, the lower bin drawer is closed only by the user input and thus it is impossible to provide convenience of use.

BRIEF DESCRIPTION OF THE DRAWINGS

Embodiments may be described in detail with reference to the following drawings in which like reference numerals refer to like elements, and wherein.

DETAILED DESCRIPTION

Figure 1:
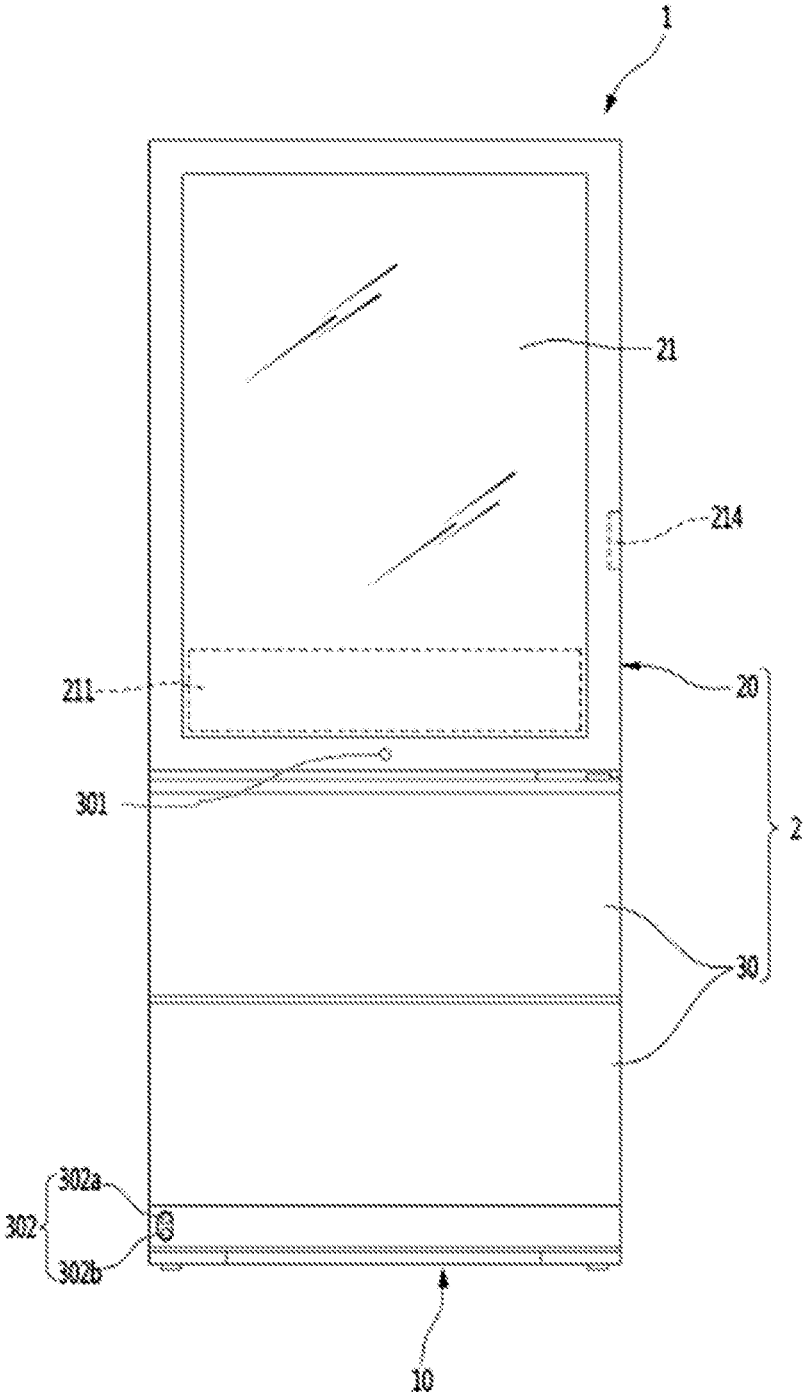
FIG. 1 is a front view illustrating a refrigerator according to an embodiment of the present disclosure.

Advantages and features of the present disclosure, and a method to achieve them may be obvious with reference to embodiments along with the accompanying drawings which are described below. However, it will be understood that present description is not intended to limit the disclosure to those exemplary embodiments. On the contrary, the disclosure is intended to cover not only the exemplary embodiments, but also various alternatives, modifications, equivalents, and other embodiments, which may be included within the spirit and scope of the disclosure as defined by the appended claims. Throughout the drawings, the same reference numerals will refer to the same or like parts.

Hereinafter, the present disclosure may be described in detail with reference to the accompanying drawings.

Figure 2:
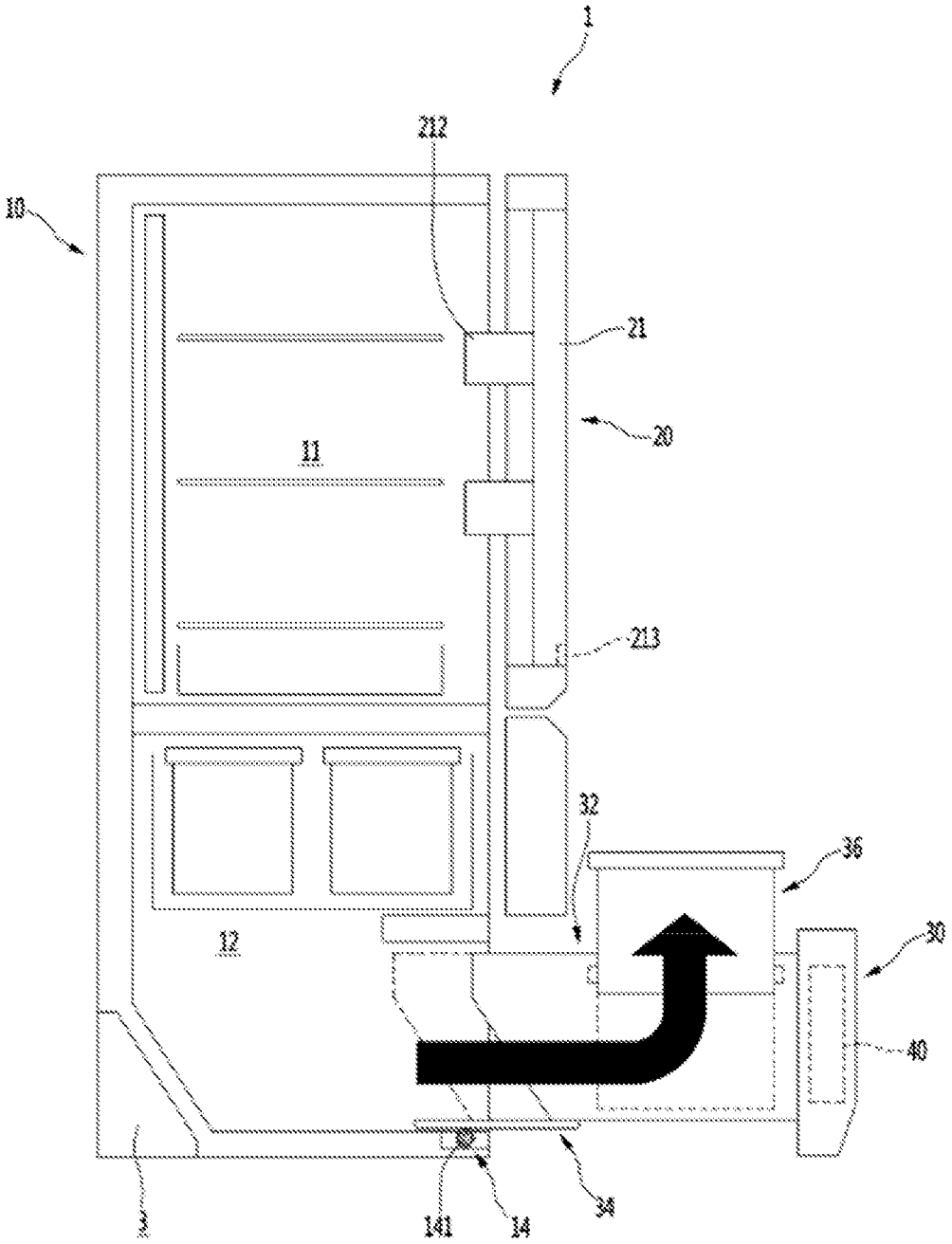
FIG. 2 is a cross-sectional view schematically illustrating a lower drawer of the refrigerator according to an embodiment of the present disclosure being raised.

FIG. 1 is a front view illustrating a refrigerator according to an embodiment of the present disclosure. FIG. 2 is a cross-sectional view schematically illustrating a lower drawer of the refrigerator being raised.

Referring to FIGS. 1 and 2, a refrigerator 1 according to the embodiment of the present disclosure includes: a cabinet 10 providing a storage space; and doors 2 closing an opened front surface of the cabinet 10, wherein the cabinet 10 and the doors 2 define an outer shape of the refrigerator 1.

The storage space inside the cabinet 10 may be partitioned into multiple spaces. For example, the multiple spaces may include an upper storage space 11 which is an upper portion of the cabinet 10 and functions as a refrigerator compartment, and a lower storage space 12 which is a lower portion of the cabinet 10 and functions as a freezer compartment. The upper portion and the lower portion of the cabinet may be provided as independent spaces maintained at different temperatures rather than provided as a refrigerator compartment and a freezer compartment, respectively. The upper portion and the lower portion of the cabinet may be called an upper space and a lower space.

The doors 2 may include: a swinging door 20 in which the upper space is opened and closed by rotation of the swinging door 20; and a drawer 30 in which the lower space is opened and closed by pushing and pulling out the drawer 30.

The lower space may further be partitioned up and down, and the drawer 30 may include an upper drawer provided at an upper portion of the lower space and a lower drawer provided at a lower portion of the lower space.

The lower space may be partitioned into two or more spaces, and accordingly, two or more drawers 30 may be provided and disposed for each space.

The swinging door 20 and the drawers 30 are made of a metal material and form an exterior exposed to the front.

Although the present disclosure has been described with reference to a refrigerator provided with the swinging door 20 and the drawers 30, the present disclosure is not limited thereto, and the present disclosure can be applied to all types of refrigerators provided with a drawer.

The swinging door 20 provided at the upper portion may be called an upper door, and the drawers 30 provided at the lower portion may be called lower doors.

At least a part of the swinging door 20 may be formed of a transparent panel assembly 21. The transparent panel assembly 21 has a structure allowing a user to see inside the refrigerator. For example, a lighting unit may be provided at the storage space or on a rear surface of the swinging door 20. The inside of the refrigerator becomes illuminated according to on-off of the lighting unit, thereby selectively allowing a user to see inside the refrigerator through the transparent panel assembly 21.

The transparent panel assembly 21 may be configured with multiple panels. A heat insulating space may be defined between the multiple panels, thereby preventing reduction of the cooling performance inside the refrigerator.

In addition, a display 211 may be provided inside the transparent panel assembly 21. Therefore, a screen is displayed by the transparent panel assembly 21.

The display 211 may be installed on the entire surface of the transparent panel assembly 21 or may be partially installed. The display 211 may be installed on the entire surface of the transparent panel assembly 21, and a screen is partially displayed.

In addition, the transparent panel assembly 21 may include a touch sensor to touch the screen displayed by the display 211 and to input a command for an operation of the refrigerator 1. Therefore, the screen displayed by the display 211 may function as a manipulation unit, and the display 211 may be called the manipulation unit.

The transparent panel assembly 21 may be configured with a separate door which opens and closes an opening of the transparent panel assembly 21 to allow access to a basket 212 provided in the swinging door 20. That is, the swinging door 20 may be configured as double doors to open and close both the swinging door 20 and the transparent panel assembly 21.

The swinging door 20 may have no transparent panel assembly 21. In this example, an additional display may be provided on a front surface of the swinging door 20 to display an operating state of the refrigerator 1.

A first proximity sensor 213 may be provided at one side of the front surface of the swinging door 20. The first proximity sensor 213 is provided to sense the proximity of the user, and may be configured as a device, such as an ultrasonic sensor or a laser sensor, capable of detecting that the user is in front of the refrigerator 1.

One side of the swinging door 20 may be provided with a first manipulation unit 214 (or first input device) that manipulates the opening of the drawers 30. The first manipulation unit 214 may be disposed on one of left and right sides of the swinging door 20 and may not be exposed to the outside.

The first manipulation unit 214 may be disposed inside the swinging door 20 and configured as a touch sensor (or a button) so that a user inputs an operation command by touching the surface of the swinging door 20.

The opening, closing, and raising operation of the drawers 30 are set by manipulation of the first manipulation unit 214. For example, the opening, closing, and raising operation of each drawer 30 may be consecutively and automatically performed through a single manipulation. Alternatively, the opening, closing, and raising operation of the drawer 30 may be performed by a separate manipulation depending on a user's setting.

The setting state of the opening, closing, and raising operation of the drawers 30 may be displayed on the display 211. When a touch manipulation of the display 211 is possible, an operation setting of the drawers 30 through the display 211 may also be possible.

The input for the operation of the drawers 30 may be valid only when the proximity of the user is sensed by the first proximity sensor 213. That is, when the user stands in front of the refrigerator 1 to use the refrigerator 1, the first proximity sensor 213 senses the user. In this state, when a manipulation signal of the first manipulation unit 214 is input, the drawers 30 are operated thereby. Therefore, the opening, closing, and raising of the drawers 30 caused by an incorrect operation can be prevented.

The swinging door 20 may be provided with a second manipulation unit 301 (or second input device). The second manipulation unit 301 may be provided on a lower front surface of the swinging door 20, and the second manipulation unit 301 may be configured to operate in a touch manner (touch sensor) or a button manner (button). The second manipulation unit 301 may also be provided in the drawers 30.

As shown in the drawings, a third manipulation unit 302 (or third input device) may be provided at a lower end of the lower drawer 30. The third manipulation unit 302 may be configured to output an imaginary switch by projecting an image on the floor and inputting an operation command in a manner that the user approaches the corresponding region. The opening, closing, and raising operation of the drawers 30 may be input through the third manipulation unit 302.

Since the third manipulation unit 302 is provided at the lower doors, the lower doors may be interrupted by the user when being automatically opened and closed. Thus, the third manipulation unit 302 may be used only for the raising operation of the lower drawer 30 (other than the opening operation of the lower drawer 30).

When the cabinet 10 has no door opening device for opening the swinging door 20, the third manipulation unit 302 may be manipulated to open the swinging door 20.

The cabinet 10 may also be provided with a sensor for detecting whether the swinging door 20 is closed or open. The closing and opening sensor for the swinging door 20 communicates with a controller (refer to a numerical reference 90 of FIG. 16) of the drawers 30, which may be described below. Thus, the controller 90 senses whether the swinging door 20 is closed or open.

The drawers 30 are manipulated to be automatically opened and/or raised by at least one of the multiple manipulation units 214, 301, and 302. Only one of the multiple manipulation units 214, 301, and 302 may be provided as needed.

The multiple manipulation units 214, 301, and 302 are provided and function to open and lift the drawers 30. The drawers 30 may be opened and raised according to a combination manipulation or a sequential manipulation of the multiple manipulation units 214, 301, and 302.

When manipulating the manipulation units 214, 301, and 302 to store food inside the lower drawer 30, the drawer 30 is pushed out forward, and then a container 36 inside the drawer 30 may be raised.

The container 36 has a predetermined height. The container 36 is seated in a lifting unit 80 (or lifting mechanism) to be described below. Thus, when the lifting unit 80 is elevated, the total height is sum of the height of the lifting unit 80 and the height of the container 36. When being elevated, the lifting unit 80 is located at a point where it is easy to access to the container 36 or easy to pick up the container 36.

The container 36 may be fully accommodated in the drawer part 32 when the drawer 30 is opened and closed, and the container 36 is located at a position above the lower storage space 12 when the lifting unit 80 is elevated.

Figure 3:
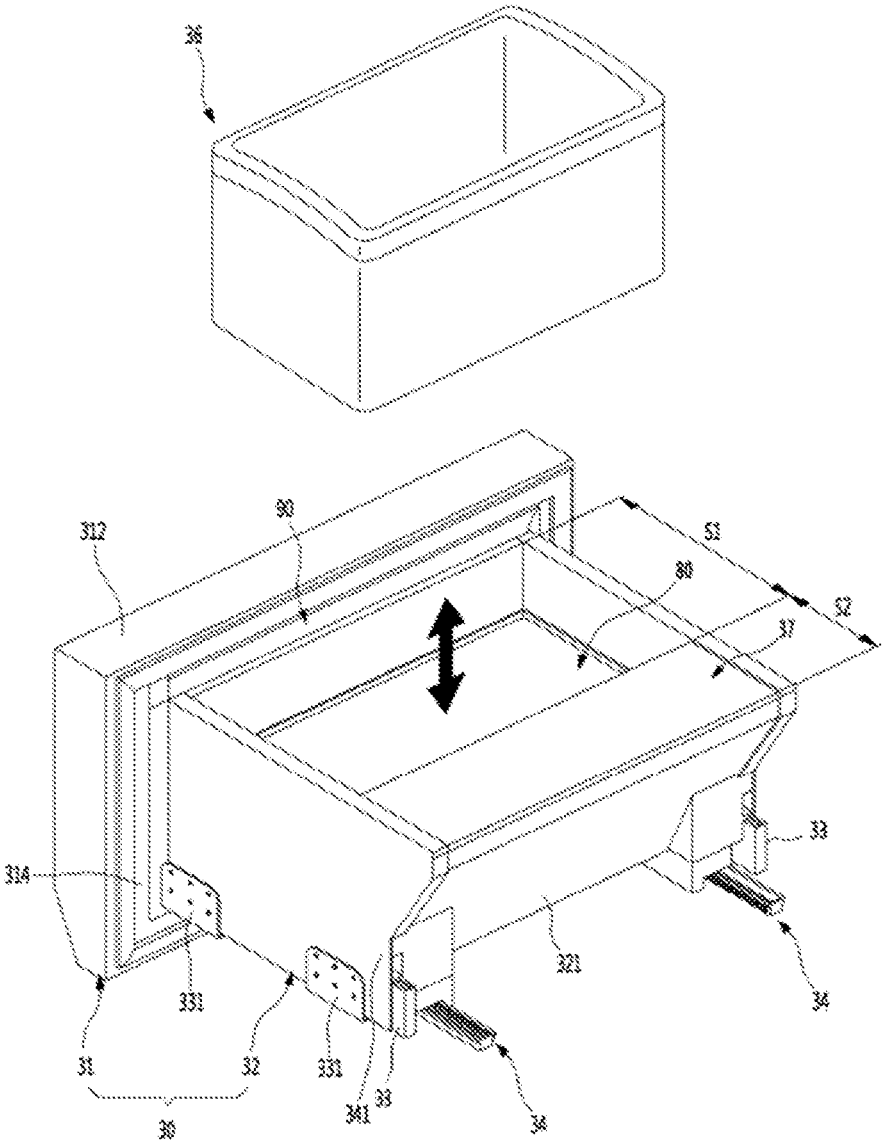
FIG. 3 is a perspective view illustrating a container of the lower drawer being separated.

A shape of the container 36 is not limited, but may have a shape corresponding to the size of a front space (refer to S1 of FIG. 3). The container 36 may have a predetermined height so that food stored therein does not escape even when the lifting unit 80 is elevated.

According to this manipulation, it is possible to easily pick up food or the container 36 inside the drawer 30 disposed at the bottom.

The drawer 30 may be automatically opened and closed by an opening/closing motor 14 and pinions 141 which are provided in the cabinet 10 and racks 34 provided on a bottom surface of the drawer 30. The container inside the lower drawer 30 is raised by a driving unit 40 (or driving device) and the lifting unit 80 provided in the drawer 30.

The drawers 30 of the present disclosure and the configuration for operation of the drawers 30 may be described in more detail. In the following description, the refrigerator 1 having two drawers 30 may be described as an example.

The drawers 30 described below may refer to a lower drawer disposed at the bottom among the two drawers 30 unless otherwise indicated, and may be simply called a drawer.

Furthermore, in the following description, when it is necessary to distinguish the drawer 30 disposed at the top and the drawer 30 disposed at the bottom, the upper drawer 30 and the lower drawer 30 may be described individually.

The embodiment of the present disclosure is not limited to the number and shape of the drawers, and it may be applicable to all refrigerators provided with a drawer in a lower storage space, which is opened and closed.

Figure 4:
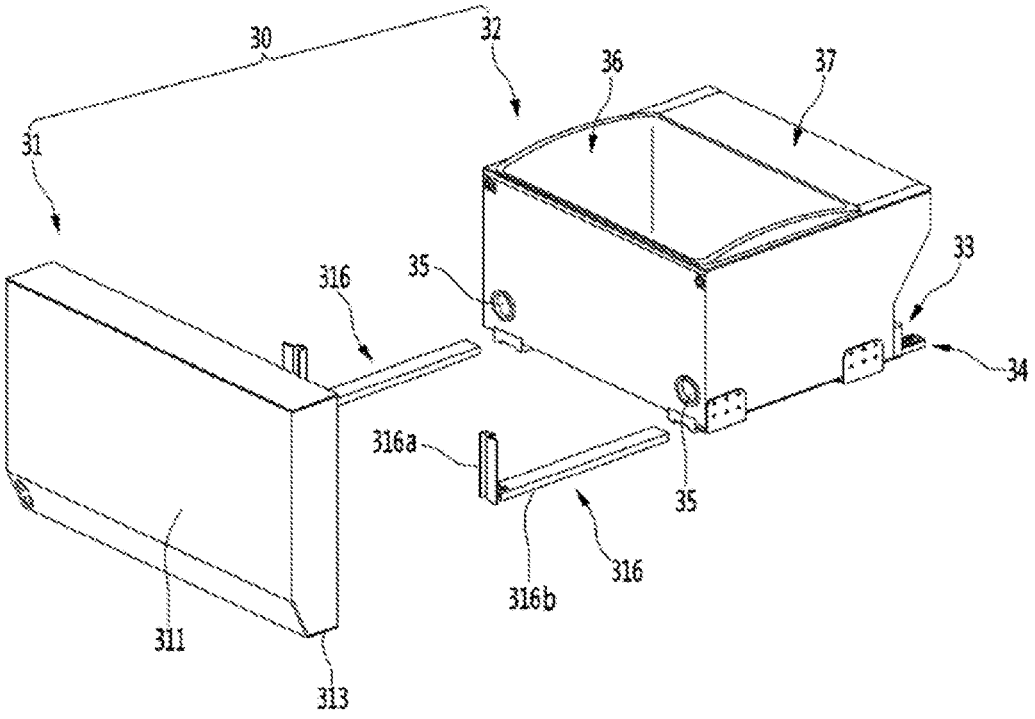
FIG. 4 is an exploded-perspective frontal view illustrating a drawer part and a front panel of the lower drawer being separated from each other.

FIG. 3 is a perspective view illustrating the container of the lower drawer being separated. FIG. 4 is an exploded-perspective frontal view illustrating the drawer part and the front panel of the lower drawer being separated from each other.

Referring to FIGS. 1 to 4, the drawer 30 includes a front panel 31 opening and closing the lower storage space; and the drawer part 32 coupled to a rear surface of the front panel 31 and pushed in and out with the front panel 31.

The front panel 31 is exposed to the outside of the cabinet 10 to provide the exterior of the refrigerator 1, and the drawer part 32 is disposed inside the cabinet 10 to provide a storage bin (or storage room). The front panel 31 and the drawer part 32 are coupled to each other and opened and closed.

The drawer part 32 may be always located on the back of the front panel 31 and provides a space for storing food or accommodating containers. The inside of the drawer part 32 defines the storage bin opened upward, and the outside of the drawer part 32 is configured by multiple plates (reference numerals 391, 392, and 395 in FIG. 12).

The plates 391, 392, and 395 may be made of a metal material such as stainless. An inner surface as well as an outer surface of the drawer part 32 may be embodied by stainless so that all of the drawer part 32 is embodied by stainless or has a stainless texture.

When the drawer 30 is closed, a machine room 3 (or machine area) may be disposed at the rear of the drawer 30.

The machine room 3 may include equipment such as a compressor and a condenser constituting a refrigeration cycle.

Thus, the rear of the drawer part 32 is configured such that an upper end protrudes backward more than a lower end, and the rear surface of the drawer part 32 may include an inclined surface 321.

Opposite lateral sides of the drawer part 32 may be provided with rails 33 guiding the drawer 30 to be opened and closed. The rails 33 may allow the drawer 30 to be mounted in the cabinet 10 in an opened and closed manner.

The rails 33 are configured to be shielded by outer side plates 391 so as not to be exposed to the outside. The rails 33 may be configured to have a multi-stage extendable rail structure.

The rails 33 may be provided with rail brackets 331, and the rail brackets 331 may extend on the opposite lateral sides of the drawer part 32 from each one side of the rails 33. The rail brackets 331 are fixedly coupled to inner wall surfaces of the refrigerator. Thus, the rails 33 may allow the drawer part 32 (i.e., the drawer 30) to be mounted in the cabinet 10 in an opened and closed manner.

The rails 33 may be provided at lower ends of the opposite lateral sides of the drawer part 32. The rails 33 are mounted in a manner such that the lower ends of the opposite lateral sides of the drawer part 32 are seated from above the rails 33, and thus the rails 33 may be called under rails.

The racks 34 are provided on the bottom surface of the drawer part 32. The racks 34 are disposed on opposite sides and linked to the opening/closing motor 14 mounted in the cabinet 10 to enable automatic opening and closing of the drawer 30. That is, the opening/closing motor 14 is driven when the manipulation unit (or input device) is manipulated so that the drawer 30 is able to be opened and closed as the racks 34 moves. The drawer 30 is able to be opened and closed stably by the rails 33.

The inside of the drawer part 32 is divided into a front space S1 and a rear space S2. In the front space S1, the lifting unit 80 (which is elevated up and down) and the container 36 are disposed. The container is disposed on the lifting unit 80 and is raised with the lifting unit 80.

Although the container 36 is shown in the form of an open basket, the container 36 may be a closed box structure such as a kimchi container, and multiple containers 36 are stacked or arranged side by side.

When opening the drawer 30, the drawer 30 may not be fully open out of the storage space due to a limitation of a pushing-out distance of the drawer part 32. Thus, the front space S1 is opened out of the storage space, and the rear space S2 is fully or partly located inside the storage space of the cabinet 10.

Such structure may be limited in the pushing-out distance of the drawers 30 by the racks 34 or the rails 33. The longer the pushing-out distance, the greater the moment applied to the drawer 30 in the opened state. Thus, it is difficult to maintain a stable state, and the rails 33 or the racks 34 may be deformed or broken.

The lifting unit 80 and the container 36 are accommodated in the front space S1, and the lifting unit 80 is moved up and down so that food or the container 36 accommodated on the lifting unit 80 can be raised together. The lifting unit 80 may be provided below the container 36. Therefore, the lifting unit 80 is covered by the container 36, and configuration of the lifting unit 80 is not exposed to the outside.

The rear space S2 may be provided with a drawer cover 37. The front space S1 and rear space S2 is partitioned by the drawer cover 37. In a state where the drawer cover 37 is equipped, front and top surfaces of the rear space S2 are shielded so that unused spaces are not exposed to the outside.

Due to provision of the drawer cover 37, when the drawer 30 is opened, the rear space S2 is covered, and only the front space S1 is exposed, thereby providing a neat exterior. Since a space other than the space where the lifting unit 80 and the container 36 are mounted is covered, problems such as food falling or getting caught in the gap during raising may be prevented or minimized.

When separating the drawer cover 37, the rear space S2 may be accesses and food may be stored in the rear space S2. In order to utilize the rear space S2, the rear space S2 may have a pocket or a container corresponding to a shape of the rear space.

The lifting unit 80 (inside the drawer part 32) may be simply detached and mounted in order to utilize the entire space inside the drawer part 32. Alternatively, the lifting unit 80 and the drawer cover 37 may be separated to utilize the entire space inside the drawer part 32.

Figure 12:
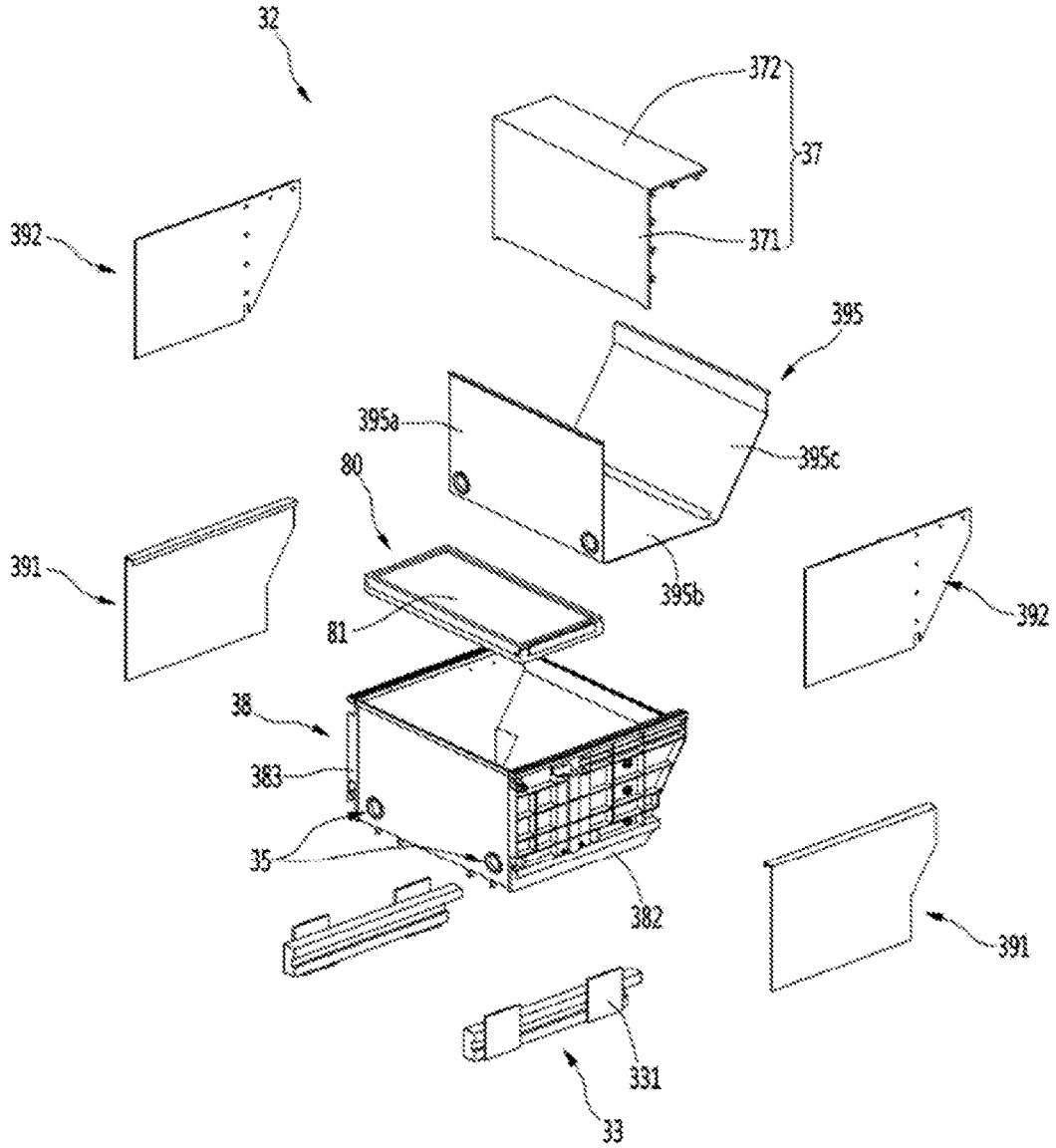
FIG. 12 is an exploded-perspective view illustrating the drawer part.

The exterior of inner and outer surfaces of the drawer part 32 may be provided by the plates (see FIG. 12 showing reference numerals 391, 392, and 395) which shield the components mounted on the drawer part 32 to make the exterior neat. The multiple plates (see FIG. 12 showing reference numerals 391, 392, and 395) may be provided and made of stainless to provide an elegant and neat exterior.

The front panel 31 and drawer part 32 (constituting the drawer 30) may have a structure that can be detached from each other. The detachable structure of the front panel 31 and the drawer part 32 allows easy assembling and easy repair.

The rear surface of the front panel 31 and the front surface of the drawer part 32 may be coupled to each other and configured to provide power for raising the lifting unit 80 when the front panel 31 and the drawer part 32 are coupled to each other.

Figure 6:
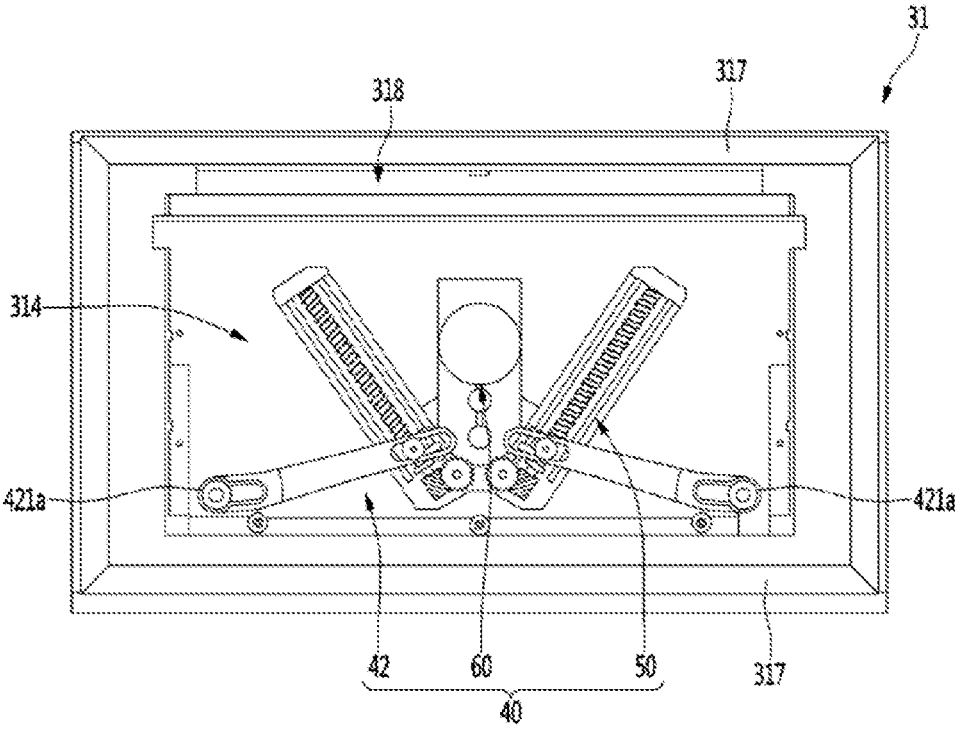
FIG. 6 is a rear view illustrating a panel cover of the front panel being removed.

The driving unit (see FIG. 6 showing reference numeral 40) for raising the lifting unit 80 may be disposed in the front panel 31 and may be selectively connected with the front panel 31 and the drawer part 32.

The driving unit provided in the front panel 31 may be composed of components operated by input of power and components transmitting power to the lifting unit 80. Therefore, when repair of the driving unit is required, it is possible to easily perform the repair by removing the front panel 31 and replacing the front panel 31.

The front panel 31 and the drawer part 32 are coupled by a pair of drawer frames 316.

Each of the drawer frames 316 includes a front panel engaging portion 316*a* extending in the vertical direction and engaged with the front panel 31 and a drawer engaging portion 316*b* extending rearward from a lower end of the front panel engaging portion 316*a*.

The front panel engaging portion 316*a* may engage with the front panel 31 by an additional engaging member or may be engaged with one side of the front panel 31 with an engaging structure. The drawer engaging portion 316*b* may be disposed to be inserted each opposite side of the drawer part 32 to be adjacent to each of the rails 33. The drawer engaging portion 316*b* may be provided in the drawer part 32 in combination with the rail 33.

With the front panel engaging portion 316*a* engaging with the front panel 31, the drawer engaging portion 316*b* is inserted into the drawer part 32 and supports the drawer part 32. The drawer engaging portion 316*b* may engage with the drawer part 32 by an additional engaging member or by a structure in which the drawer engaging portion 316*b* and the drawer part 32 are combined with each other.

In order to connect the driving unit 40 and the lifting unit 80 with each other when the front panel 31 and the drawer part 32 are coupled to each other, drawer holes 35 are provided in the front surface of the drawer part 32 to expose a portion of the lifting unit 80.

The front panel 31 is configured to substantially open and close the storage space of the cabinet 10 and provide the front exterior of the refrigerator 1.

The exterior of the front panel 31 is configured by an outer case 311 providing the front surface and a part of a circumferential surface, a front panel liner 314 providing the rear surface, an upper decoration 312 and a lower decoration 313 providing upper and lower surfaces. The inside of the front panel 31, which is between the outer case 311 and the front panel liner 314, may be filled with an insulator.

The front panel 31 constituting the drawer 30 and the driving unit 40 provided in the front panel 31 may be described in more detail with reference to the accompanying drawings.

Figure 5:
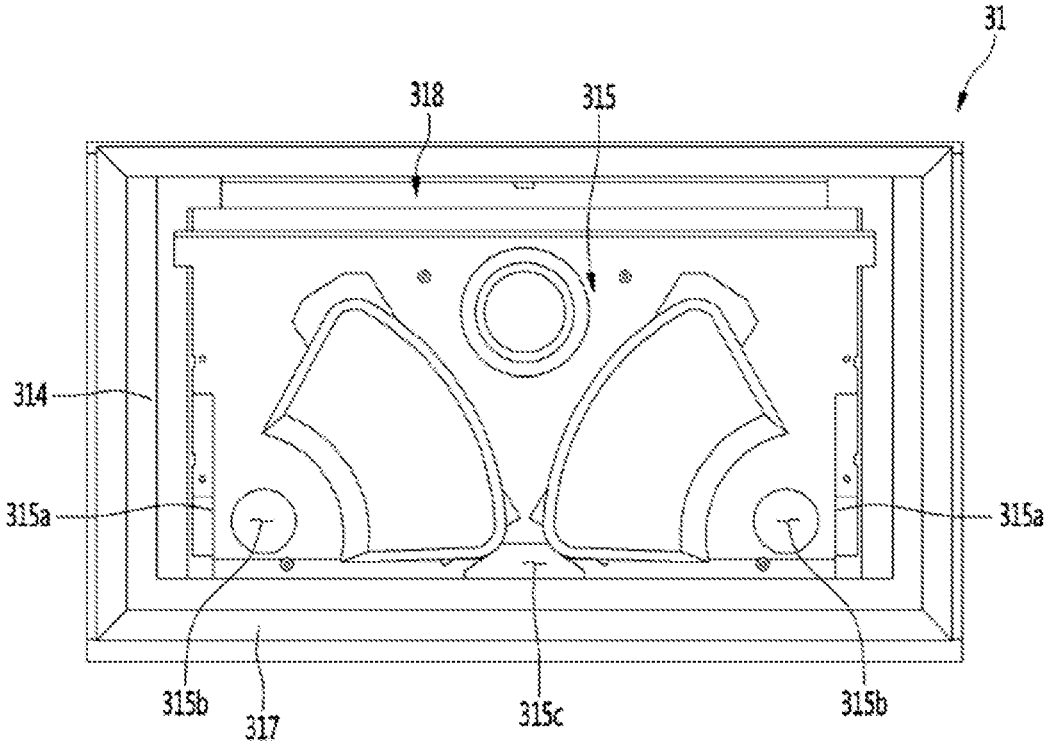
FIG. 5 is a rear view illustrating the front panel.
Figure 7:
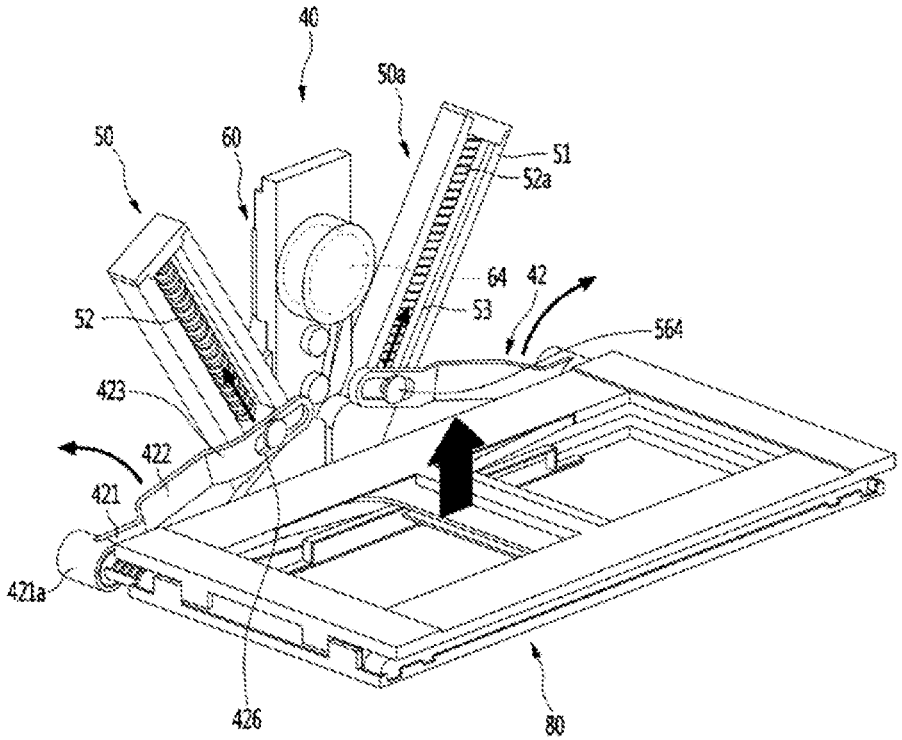
FIG. 7 is a perspective view illustrating a driving unit and a lifting unit being connected to each other.
Figure 8:
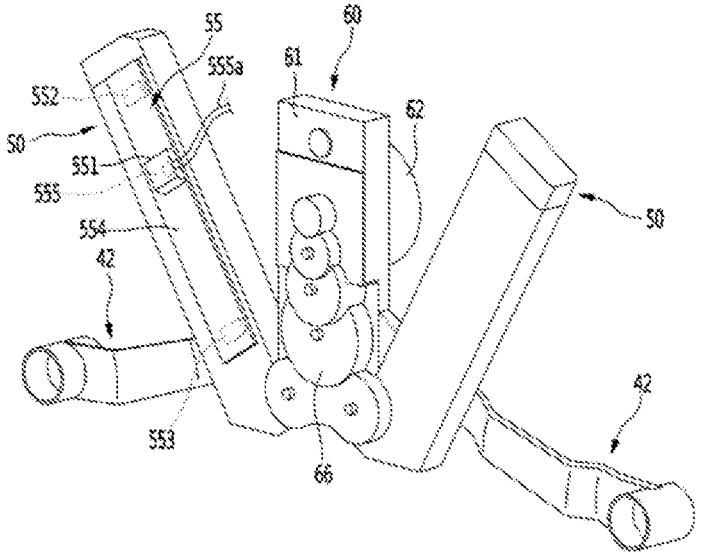
FIG. 8 is a front perspective view illustrating the driving unit.
Figure 9:
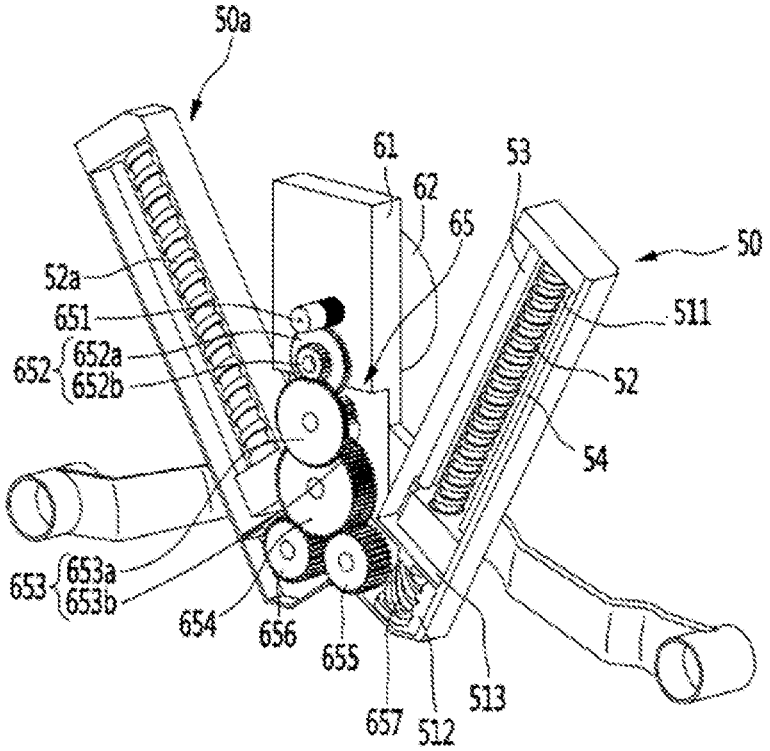
FIG. 9 is a front perspective view illustrating an inner structure of the driving unit.
Figure 10:
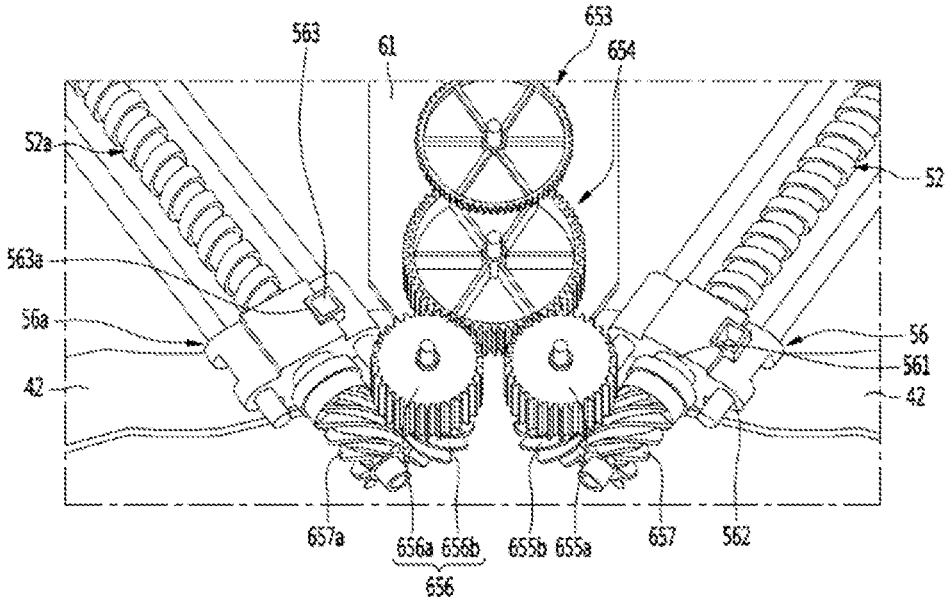
FIG. 10 is a partially enlarged view illustrating the structure in which power is transmitted to screws of the driving unit.

FIG. 5 is a rear view illustrating the front panel. FIG. 6 is a rear view illustrating a panel cover of the front panel being removed. FIG. 7 is a perspective view illustrating the driving unit and the lifting unit being connected to each other. FIG. 8 is a front perspective view illustrating the driving unit. FIG. 9 is a front perspective view illustrating an inner structure of the driving unit. FIG. 10 is a partially enlarged view illustrating the structure in which power is transmitted to screws of the driving unit.

Referring to FIGS. 4 to 10, the outer case 311 provides the front surface of the front panel 31, and the front panel liner 314 provides the rear surface of the front panel 31.

The driving unit 40 for operating the lifting unit 80 may be provided inside the front panel 31. The driving unit 40 may be disposed inside the front panel 31, but is provided inside a space defined by the front panel liner 314 rather than embedded in the insulator. The driving unit 40 may be shielded by a panel cover 315 so as not to be exposed to the outside.

The insulator may be filled between the outer case 311 and the front panel liner 314 to insulate the inside of the lower storage space 12.

The front panel liner 314 is configured with a front panel depression that is depressed inward. The front panel depression may be configured in a shape corresponding to a shape of the driving unit 40 and that is depressed inwardly of the drawer 30.

The front panel depression may be further depressed to mount electric components including a drawer light 318 illuminating the inside of the refrigerator.

The drawer light 318 may extend horizontally from the left side to the right side of the rear surface of the drawer 30 and may be positioned at the top of an inner region of a gasket 317 provided along a circumference of the rear surface of the drawer 30.

The drawer light 318 consists of multiple LEDs and is configured such that light emitted from the LEDs is directed inside the drawer 30, and more particularly toward the inside of the drawer part 32. Accordingly, the drawer light 318 may illuminate inside of the drawer part 32 when the drawer 30 is opened.

The panel cover 315 is to provide the exterior of the rear surface of the front panel 31 and shields the driving unit 40 mounted in the front panel 31. The panel cover 315 may be formed in a plate shape and may shield the driving unit 40 to prevent the driving unit 40 from being exposed.

The panel cover 315 may be configured with a cover depression at a corresponding position in which the driving unit 40 can be covered from the rear. The cover depression may be configured such that the front surface of the panel cover 315 (i.e., a surface facing the driving unit 40) is depressed, and the rear surface of the panel cover 315 (i.e., a surface facing the lower storage space) protrudes.

Side cutouts 315*a* may be configured at left and right side ends of the panel cover 315. The side cutouts 315*a* provide a space for the drawer frames 316 to be engaged with the front panel.

Cover holes 315*b* may be formed at opposite lower sides of the panel cover 315. The cover holes 315*b* are configured such that accommodating portions 421*a* of levers 42 that are one kind of component of the driving unit 40 are exposed through the cover holes 315*b* so that the accommodating portions 421*a* may be accessed through the cover holes 315*b*. The cover holes 315*b* may be located at position facing the drawer holes 35.

Figure 13:
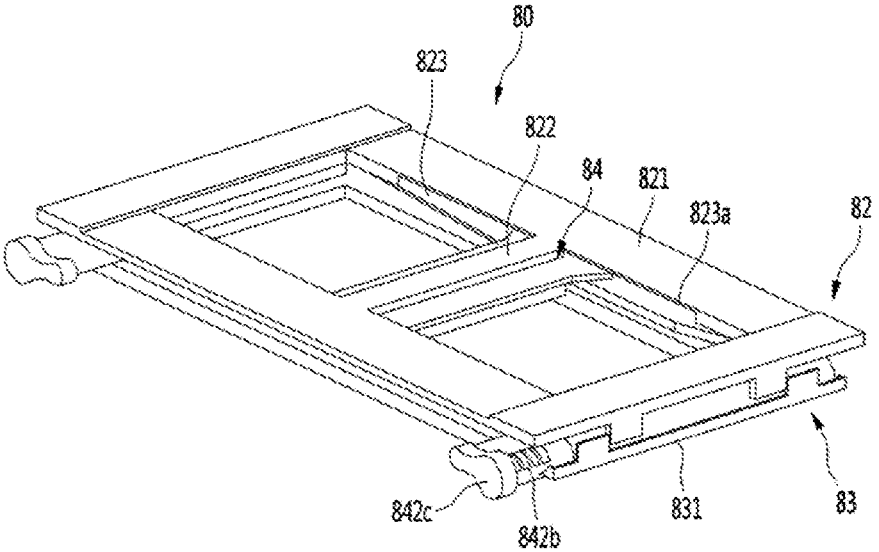
FIG. 13 is a perspective view illustrating the lifting unit according to an example embodiment of the present disclosure.

Accordingly, when the front panel 31 and the drawer part 32 are coupled to each other, the cover holes 315*b* and the drawer holes (see FIG. 13 showing reference numeral 35) communicate with each other. Thus, the accommodating portions 421*a* and engaging portions 842*c* of the lifting unit 80 are engaged with each other through the cover holes 315*b* and the drawer holes 35. That is, the driving unit 40 and the lifting unit 80 are connected to each other, and thus the lifting unit 80 can be raised according to the operation of the driving unit 40.

It is also possible to separate only the lifting unit 80 by separating the accommodating portions 421*a* and engaging portions 842*c* while the front panel 31 and the drawer part 32 are coupled.

A cable hole 315*c* through which cables connected to electrical components (such as the driving unit 40 and the drawer light 318 provided in the front panel 31) may be formed at a lower center of the panel cover 315. The cables coming in and out through the cable hole 315*c* are connected to the cabinet 10 through the lower portion of the drawer part 32.

The gasket 317 is provided along the circumference of the rear surface of the front panel 31. The gasket 317 is hermetically in contact with the front surface of the cabinet 10 in a state where the drawer 30 is close.

As described above, the driving unit 40 is shielded by the panel cover 315 and disposed inside the front panel 31. The power of the driving unit 40 is transmitted to the lifting unit 80. The driving unit 40 simultaneously transmits the power to both left and right sides of the lifting unit 80 so that the lifting unit 80 is elevated and lowered in a level state without being inclined or biased to one side under any circumstance.

A configuration of the driving unit 40 may be described in detail.

The driving unit 40 includes: a motor assembly 60; a pair of screw units 50 and 50*a* disposed on left and right sides of the motor assembly 60; and a pair of levers 42 connected to the screw units 50 and 50*a*, respectively.

The motor assembly 60 may be located at the central portion in a lateral direction of the front panel 31. The motor assembly 60 is configured to enable the operation of the screw units 50 and 50*a* and the levers 42 on both sides by driving the motor assembly 60 including one lifting motor 64.

The motor assembly 60 adjusts the magnitude of the deceleration and transmission force through a combination of multiple gears.

The motor assembly 60 has a structure in which the lifting motor 64 and the gears are arranged up and down in order to minimize a space recessed to mount the front panel 31. The motor assembly 60 is configured such that width thereof in the lateral direction is wide in order to minimize the thickness thereof in the front and rear direction.

The lifting motor 64 constituting the motor assembly 60 may protrude toward the drawer part 32 side to minimize the depth of depression of the front panel 31 to ensure thermal insulation performance.

The lifting motor 64 is to provide power for elevating the lifting unit 80 and may be configured to perform forward and reverse rotation. Therefore, when the raising signal for the lifting unit 80 is input, the lifting motor 64 may provide forward or reverse rotation and provide power for elevating the lifting unit 80. The lifting motor 64 may stop when a stop signal is input due to load of the lifting motor 64 or a detection by a sensor.

The motor assembly 60 includes a motor case 61 in which the lifting motor 64 is installed, and a motor cover 62 coupled to the motor case 61 and covering the lifting motor 64.

A shaft of the lifting motor 64 may protrude toward an opposite side of the motor cover 62 from the motor case 61. The motor assembly 60 may include a power transmission unit (or power transmitter) to transmit power of the lifting motor 64. The power transmission unit is positioned opposite the lifting motor 64 with respect to the motor case 61.

The power transmission unit may be composed of a combination of multiple gears, and the gears may be shielded by a cover member 66 mounted on the opposite side of the lifting motor 64.

The power transmission unit may include a drive gear 651 connected to the shaft of the lifting motor 64 passing through the motor case 61. The power transmission unit may include a first transmission gear 652 engaged with the drive gear 651 at the bottom of the drive gear 651.

The first transmission gear 652 may be, for example, a multi-speed gear. For example, the first transmission gear 652 may include a first gear 652*a* engaged with the drive gear 651 and a second gear 652*b* having a diameter smaller than that of the first gear 652*a*. The first gear 652*a* and the second gear 652*b* may be spur gears.

The power transmission unit may include a second transmission gear 653 engaged with the first transmission gear 652. The second transmission gear 653 may engage with the first transmission gear 652 at the bottom of the first transmission gear 652. The second transmission gear 653 may include a first gear 653*a* engaged with the second gear 652*b* of the first transmission gear 652 and a second gear 653*b* having a diameter smaller than that of the first gear 653*a*.

The first gear 653*a* and the second gear 653*b* of the second transmission gear 653 may be spur gears. The second gear 653*b* of the second transmission gear 653 is positioned at the bottom of the first gear 652*a* of the first transmission gear 652.

Thus, due to the first transmission gear 652 and the second transmission gear 653, the width of the motor assembly 60 in the lateral direction may be prevented from being extended.

The power transmission unit may include a third transmission gear 654 engaged with the second transmission gear 653. The third transmission gear 654 is engaged with the second gear 653*b* of the second transmission gear 653 at the bottom of the second gear 653*b*.

The third transmission gear 654 may be a spur gear. A portion of the third transmission gear 654 may be positioned to overlap the second transmission gear 653 in the front and rear direction.

The motor case 61 may be provided with a gear shaft supporting the multiple transmission gears to be rotatable.

The power transmission unit may include a pair of cross gears 655 and 656 engaged with the third transmission gear 654. The pair of cross gears 655 and 656 are disposed to be spaced apart from each other in the lateral direction and engaged with the third transmission gear 654 at positions where each center of rotation is lower than the center of rotation of the third transmission gear 654.

In order to be engaged with the third transmission gear 654, a cross gear 655 includes a spur gear 655*a* and a first helical gear 655*b*, and a cross gear 656 includes a spur gear 656*a* and a first helical gear 656*b*.

Rotation axes of the cross gears 655 and 656 disposed on opposite sides in the lateral direction to be spaced apart from each other are parallel to each other.

The power transmission unit may include a pair of second helical gears 657 and 657*a* engaged with the cross gears 655 and 656, respectively.

The second helical gears 657 and 657*a* are engaged with the first helical gears 655*b* and 656*b*. The second helical gears 657 and 657*a* are arranged such that rotational axes thereof cross the rotation axes of the cross gears 655 and 656. Thus, the first helical gears 655*b* and 656*b* are engaged with the second helical gears 657 and 657*a*, respectively, in a crossing manner to transmit rotation.

The rotation axes of cross gears 655 and 656 extend in the front and rear direction, and the rotation axes of the second helical gears 657 and 657*a* extend in the up and down direction. The rotation axes of the second helical gears 657 and 657*a* disposed on the opposite sides in the lateral direction may be inclined in respective directions in a manner being farther apart from each other from the bottom to the top.

As described above, by using the pair of helical gears, structure for power transmission can be compact, and the power transmission direction can be easily changed. In particular, even when a large amount of power is transmitted for elevating the lifting unit 80, noise is not greatly generated.

The pair of screw units 50 and 50*a* are disposed at the left and right sides of the motor assembly 60.

The pair of screw units 50 and 50*a* are disposed in the left and right sides inside the front panel 31. The pair of screw units 50 and 50*a* differ only in mounting positions thereof, but the structure and shape thereof are identical.

The power of the lifting motor 64 is transmitted from bottom portions of the screw units 50 and 50*a*.

The screw units 50 and 50*a* are provided to be symmetrical about the motor assembly 60. Thus, the motor assembly 60 is disposed between the screw units 50 and 50*a*, and the screw units 50 and 50*a* disposed at the opposite sides become close to each other from the top to bottom.

The screw units 50 and 50*a* include screws 52 and 52*a*, respectively, which receive the power of the lifting motor 64 and are rotated thereby. The screws 52 and 52*a* extend in the up and down direction while upper ends thereof face outward and lower ends thereof face inward.

The screws 52 and 52*a* are connected to the second helical gears 657 and 657*a*, respectively. That is, the screws 52 and 52*a* rotate with the second helical gears 657 and 657*a* when the second helical gears 657 and 657*a* rotate. For example, an insertion portion may be formed in each of the second helical gears 657 and 657*a*, and a receiving recess may be formed in each of the screws 52 and 52*a* to accommodate the insertion portion.

Thus, the screws 52 and 52*a* are also disposed at the left and right sides of the motor assembly 60 to be symmetrical about the motor assembly 60. The screws 52 and 52*a* may be inclined with the same rotation axes of the second helical gears 657 and 657*a*. Thus, the screws 52 and 52*a* are farther apart from each other from the bottom to the top.

The screw units 50 and 50*a* may include screw holders 56 and 56*a*, respectively, through which the screws 52 and 52*a* pass to be coupled.

The screw holders 56 and 56*a* are moved up and down along the screws 52 and 52*a* when the screws 52 and 52*a* rotate. The screw holders 56 and 56*a* may be coupled to the levers 42. When the screw holders 56 and 56*a* are moved, the levers 42 rotate.

Each center of the screw holders 56 and 56*a* may be formed with a holder through-hole 561. The holder through-hole 561 extends each of the screw holders 56 and 56*a* from the top to bottom, and each of the screws 52 and 52*a* is inserted and mounted to the corresponding holder through-hole 561 by passing therethrough. An inner surface of the holder through-hole 561 is formed with a thread engaged with the screw. Thus, when the screws 52 and 52*a* rotate, the screw holders 56 and 56*a* are movable with the screws 52 and 52*a*.

Guide holes 562 may be formed at left and right sides of the holder through-hole 561. The guide holes 562 are portions through which guide bars 53 and 54 to be described later pass, and the screw holders 56 and 56*a* are moved along the guide bars 53 and 54. A bearing or other components for reducing friction may be provided on each inner surface of the guide holes 562 to facilitate the movement of the screw holders 56 and 56*a*.

The pair of the guide bars 53 and 54 pass the guide holes 562 such that stable raising is possible without any left and right movement of the screw holders 56 and 56*a*. Even when a heavy load is applied for the driving of the lifting unit 80, the stable raising is possible, and noise is not generated.

The screw holder 56*a* may be provided with a magnet 563. For example, the screw holder 56*a* may be provided with a magnet mounting recess 563*a* having a structure into which the magnet 563 is inserted by press fitting.

The magnet 563 is to detect a location of the screw holder 56*a*. A lifting sensor 55 may sense when the screw holder 56*a* is located at the bottom or top of the screw 52*a*.

That is, completion of raising and lowering of the lifting unit is determined by the lifting sensor 55 when detecting the magnet 563 mounted on the screw holder 56*a*.

Although not shown in detail, an opposite side of a rear surface of the screw holder 56*a* provided with the magnet 563 (i.e., a front surface of the screw holder) may have a structure in which each holder connector 564 is mounted, and also a front surface of the screw holder 56 has the same.

Holder connectors 564 are to connect the levers 42 and the screw holders 56 and 56*a*. The holder connectors 564 are fixedly mounted to the screw holders 56 and 56*a*. That is, the holder connectors 564 are coupled to the screw holders 56 and 56*a* while penetrating the levers 42. Each of the levers 42 may include a rectangular slot 426 so that the holder connectors 564 do not interfere while the levers 42 rotate.

Since the screw units 50 and 50*a* are disposed on the left and right sides, virtual extension lines of the screws 52 and 52*a* on the left and right sides are crossed with each other outside the driving unit 40.

The levers 42 are to connect the screw holders 56 and 56*a* and the lifting unit 80. Opposite ends of each of the levers 42 are coupled to the screw holders 56 and 56*a* and the lifting unit 80. Each of the screw units 50 and 50*a* may include a housing 51 accommodating the screws 52 and 52*a*.

A pair of housings 51 may provide outer shapes of the screw units 50 and 50*a* and define space accommodating the screws 52 and 52*a* and the screw holders 56 and 56*a*. An opened portion of the housing 51 may be covered by a cover member 66.

The housings 51 may be made of a plate-shaped metal material and bent or may be made of a plastic material.

Each of the housings 51 includes a first accommodating portion 511 where the screws 52 and 52*a* are accommodated and a second accommodating portion 512 where the second helical gears 657 and 657*a* are accommodated.

The first accommodating portion 511 and the second accommodating portion 512 are partitioned by a partition wall 513. The second accommodating portion 512 is located below the first accommodating portion 511.

The second accommodating portion 512 partly accommodates the cross gears 655 and 656. That is, the cross gears 655 and 656 and the second helical gears 657 and 657*a* are connected respectively in the second accommodating portion 512.

Each lower portion of the screws 52 and 52*a* penetrates the partition wall 513, and the screws 52 and 52*a* penetrating partition walls 513 are engaged with the second helical gears 657 and 657*a*.

Each of the housings 51 is provided with one or more guide bars 53 and 54 guiding the screw holders 56 and 56*a* to move upward. The one or more guide bars 53 and 54 extend alongside the screws 52 and 52*a* while spaced apart from the screws 52 and 52*a*.

With respect to multiple guide bars 53 and 54 provided in each of the housings 51, each of the screws 52 and 52*a* may be disposed between the multiple guide bars 53 and 54 to prevent the screw holders 56 and 56*a* from being tilted either to the left or right side about the screws 52 and 52*a*.

The motor case 61 and a pair of housings 51 may be integrally provided. The single cover member 66 may cover the motor case 61 and the pair of housings 51.

That is, the cover member 66 is coupled to the motor case 61 and covers the power transmission unit. The cover member 66 is coupled to the pair of housings 51 and covers the screws 52 and 52*a*, the guide bars 53 and 54, and the screw holders 56 and 56*a*.

The cover member 66 may include multiple portions respectively covering and opening or closing the power transmission unit and the screw units 50 and 50*a*.

According to the embodiment, since the driving unit 40 is provided in a single module form, the driving unit 40 is compact so that the driving unit 40 can be easily installed on the front panel 31.

Since the one cover member 66 covers the motor case 61 and the pair of housings 51 together, when removing the cover member 66, the power transmission unit or the inside of the housing 51 can be easily accessed, which facilitates repair.

The lifting sensor 55 may be provided at one screw unit 50*a* of the screw units 50 and 50*a* on the left and right sides. Since the screw units 50 and 50*a* on the left and right sides operate simultaneously by the one motor assembly 60, even when the lifting sensor 55 is provided only on the screw unit 50*a*, the operation of the lifting unit 80 may be effectively detected. Therefore, the lifting sensor 55 may be provided in either of the screw units 50 and 50*a* disposed on the left and right sides.

The lifting sensor 55 may determine whether the elevation of the lifting unit 80 starts and is completed. The lifting sensor 55 may determine whether the elevation of the lifting unit 80 starts and is completed based on the operation of the driving unit 40.

The lifting sensor 55 is mounted on the cover member 66 and disposed longitudinally along the screw unit 50*a*.

The lifting sensor 55 includes a support plate 551, sensors 552 and 553 mounted on the support plate 551, and a case 554 accommodating the support plate 551.

The plate-shaped support plate 551 is configured such that a pair of sensors 552 and 553 are mounted on opposite sides. The support plate 551 is made of a plate-like material on which the sensors 552 and 553 can be fixedly mounted at detecting positions. The support plate 551 is a plate where the sensors 552 and 553 are mounted.

The sensors 552 and 553 may be embodied by sensors detecting the magnet 563. The sensors may be hall sensors detecting a location of the magnet. If necessary, other sensors or devices detecting the magnet 563 may be provided in place of the hall sensors.

Other configuration or device detecting a specific position of the screw holder 56*a* may be provided in place of the magnet 563 and the hall sensors.

One of the sensors 552 and 553 is mounted in a position corresponding to a position of the magnet 563 when the lifting unit 80 is fully elevated, and a remaining one is mounted in a position corresponding to a position of the magnet 563 when the lifting unit 80 is fully lowered. Therefore, when any one of the pair of sensors 552 and 553 senses the magnet 563, it is determined that the lifting unit 80 is fully elevated or lowered.

From a state the sensors 552 and 553 detect the magnet 563, when a location of the magnet 563 is not detected anymore, it is determined that the elevation or lowering of the lifting unit 80 starts.

The support plate 551 provided with the sensors 552 and 553 is accommodated in the case 554. The case 554 may be part of the cover member 66. The case 554 is recessed on an inner surface of the cover member 66 and provides a space where the support plate 551 is accommodated. The case 554 may be configured separately to be mounted on the cover member 66.

The case 554 provides a space where the support plate 551 is accommodated. The support plate 551 is provided with a connector 555. The connector 555 is configured to be connected to a wire extending from the pair of sensors 552 and 553 and connected to an electrical wire 555*a* from the outside. That is, the outside electrical wire may be connected by coupling the connector 555 without need for separating the support plate 551 or the sensors 552 and 553.

When the support plate 551 is a plate where the sensors 552 and 553 are mounted, the connector 555 may be disposed on the support plate 551 where a connector mounting portion 951 is provided.

Figure 11:
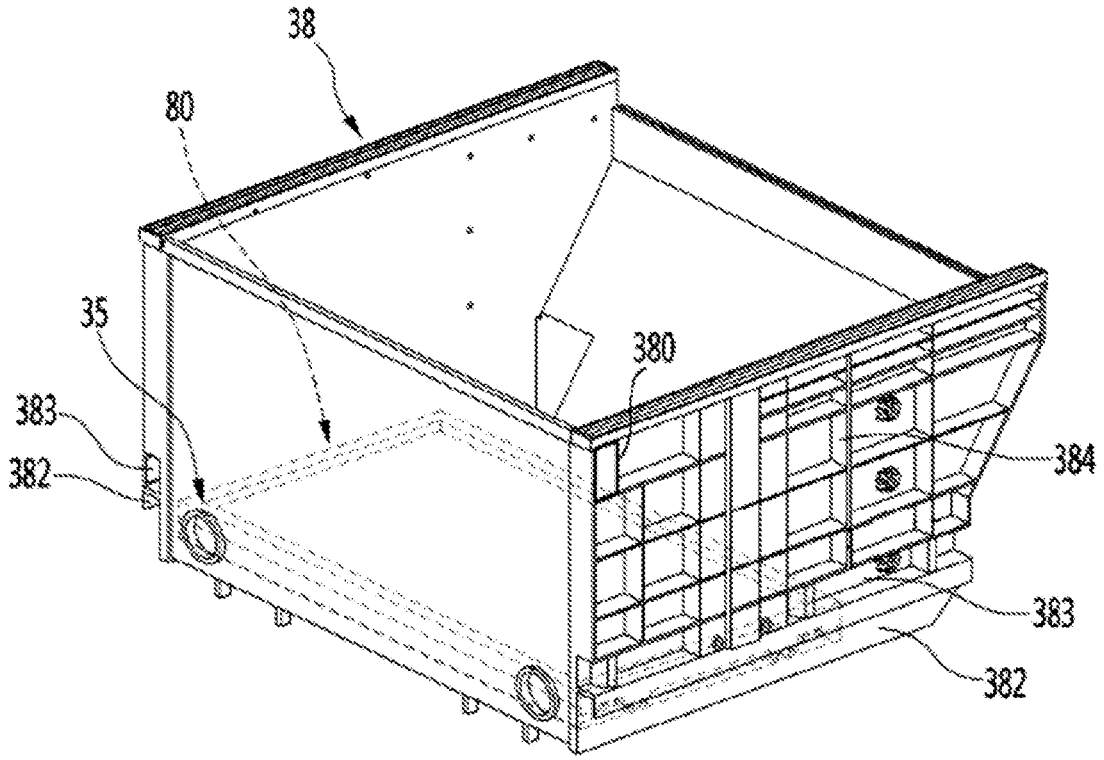
FIG. 11 is a perspective view illustrating the drawer part.

FIG. 11 is a perspective view illustrating the drawer part. FIG. 12 is an exploded-perspective view illustrating the drawer part.

Referring to FIGS. 3, 11, and 12, the drawer part 32 includes: a drawer main body 38 providing the overall shape of the drawer part 32; the lifting unit 80 provided inside the drawer main body 38 and raising the container and food; and the multiple plates 391, 392, and 395 providing an inner appearance of the drawer part 32.

The drawer main body 38 may be injection-molded from a plastic material to define the entire shape of the drawer part 32. The drawer main body 38 has a basket shape with an open upper surface to provide a food storage bin therein. A rear surface of the drawer main body 38 may be the inclined surface 321, thus preventing interference with the machine room 3.

The drawer frames 316 are mounted to opposite sides of the drawer part 32. The drawer frames 316 are coupled to frame mounting portions 383 provided on opposite sides on a lower surface of the drawer part 32 or provided on lower portions of left and right surfaces of the drawer part 32. With the drawer frames 316 coupled to the drawer part 32, the drawer part 32 and the front panel 31 are integrally combined and opened and closed together.

The drawer frames 316 and the drawer part 32 may be coupled to each other by an additional coupling member or by a structure of the drawer frames 316 and the drawer part 32 are combined with each other.

The racks 34 are provided on the left and right sides of the lower surface of the drawer part 32. The drawer part 32 is opened and closed by the racks 34. The drawer part 32 may be at least partially located inside the storage space in a state where the cabinet 10 is mounted. The racks 34 are engaged with pinion gears 141 provided on the bottom surface of the storage space. Thus, when the opening/closing motor 14 operates, the pinion gears 141 rotates so that the rack 34 moves and the drawer 30 is opened or closed.

Rail mounting portions 382, where the rails 33 guiding the drawer main body 38 to be opened and closed are mounted, are configured at the lower portions of the opposite lateral surfaces of the drawer main body 38. The rail mounting portions 382 extend from the front end to the rear end, and spaces are provided therein to accommodate the rails 33.

The rails 33 have a multi-stage extendable structure in which one end thereof is fixed to the storage space inside the cabinet 10 and a remaining end is fixed to the rail mounting portions 382 so that the drawers 30 can be stably opened and closed.

Figure 19:
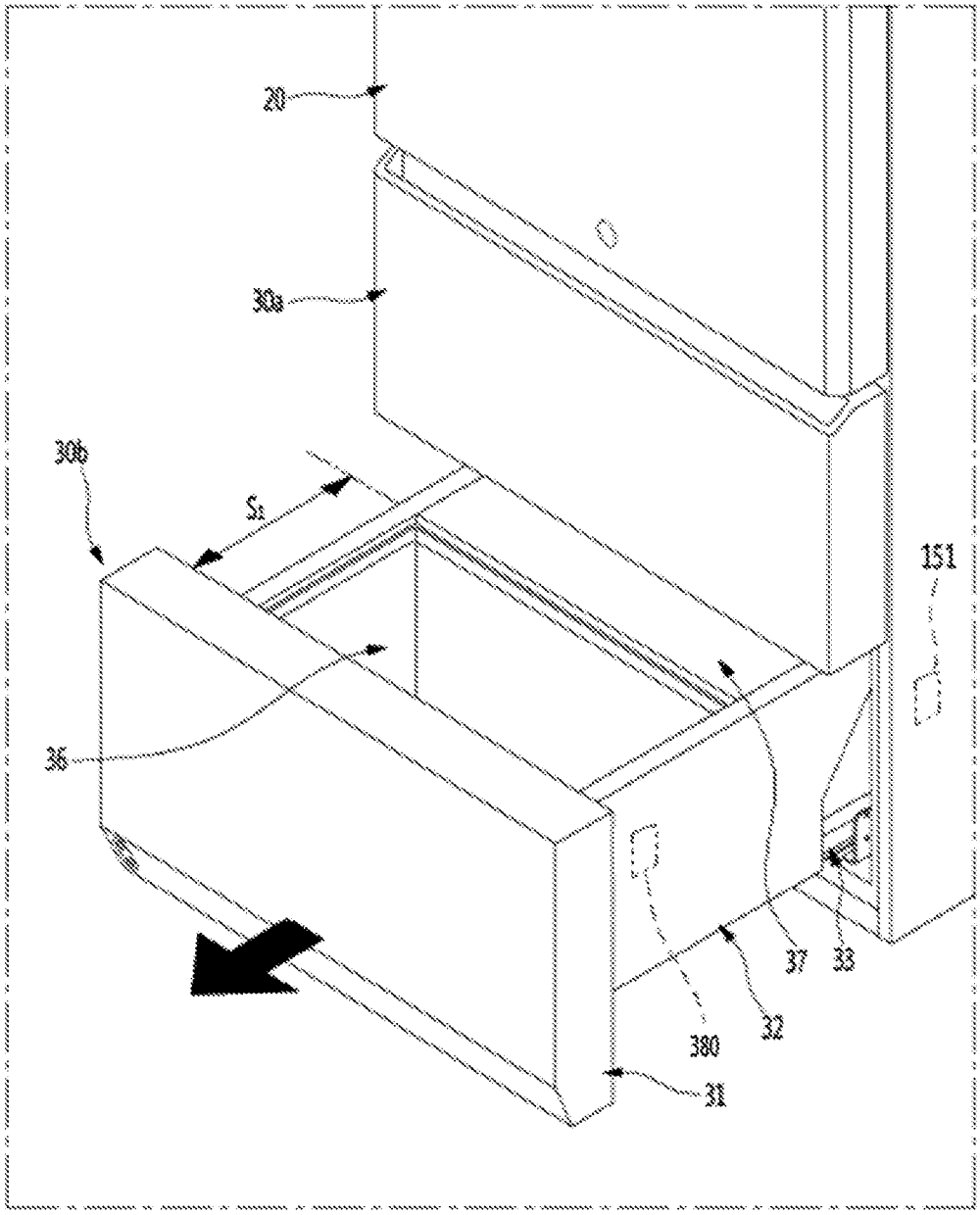
FIG. 19 is a perspective view illustrating a state of the drawer fully opened.

A magnet 380 is provided on one side of the opposite lateral surfaces of the drawer main body 38. An open/close sensor (see FIG. 19 showing reference numeral 151) is provided inside the cabinet 10 at a position corresponding to a position of the magnet 380 when the drawer 30 is fully closed.

The open/close sensor 151 detects whether the drawer 30 is opened or closed. The open/close sensor 151 detects whether the closing of the drawers 30 is completed and whether the opening of the drawer 30 starts.

That is, the open/close sensor 151 detects the magnet 380 provided on the one side of the drawer 30 when the drawer 30 is fully closed so that it is possible to determine whether the drawer 30 is closed.

When the drawer 30 starts to be opened from a closed state, the magnet 380 moves together with the drawer. In this example, the open/close sensor 151 does not detect the magnet 380 and thus it is determined that the drawer 30 is opened. That is, from a state that the open/close sensor 151 detects the magnet 380, when the magnet 380 is not detected anymore, it is determined that the opening is started.

A location of the magnet 380 may change, and according to the location of the magnet 380, a location of the open/close sensor 151 may change.

When the open/close sensor 151 detects full closure of the drawers 30, operation of the opening/closing motor 14 is stopped.

The open/close sensor 151 may have a switch-like structure, but various structures detecting the opening and closing of the drawer 30 may also be applied.

The drawer main body 38 is provided with the multiple plates 391, 392, and 395 that are made of a plate metal material such as stainless and provide a part of the interior and exterior of the drawer main body 38.

The outer side plates 391 are provided on left and right outer surfaces of the drawer main body 38. The outer side plates 391 are mounted to the left and right surfaces of the drawer main body 38 to provide the exterior of the surfaces. The outer side plates 391 prevent the components including the drawer frames 316 and the rails 33 mounted to the opposite sides of the drawer main body 38 from being exposed to the outside.

Multiple reinforcing ribs 384 are provided on the outer side surfaces of the drawer main body 38 in a manner intersecting in horizontal and vertical directions. The reinforcing ribs 384 increase the strength of the drawer main body 38 so that the drawer main body 38 can firmly maintain a shape thereof even though the total weight of the drawer is increased due to the driving unit 40 and the lifting unit 80.

The reinforcing ribs 384 support the outer side plates 391 mounted to opposite side surfaces, thereby firmly maintaining the shape of the drawer part 32.

Inner side plates 392 are provided on left and right inner surfaces of the drawer main body 38. The inner side plates 392 are mounted to the left and right surfaces of the drawer main body 38 and provide inner left and right surfaces of the inside.

An inner plate 395 includes a front portion 395*a*, a bottom portion 395*b*, and a rear portion 395*c* which have sizes and shapes corresponding to an inner front surface, an inner bottom surface, and an inner rear surface of the drawer main body 38.

The inner side plates 392 and the inner plate 395 form entire inner surfaces of the drawer main body 38 and provide a metallic texture to the inner surfaces of the drawer main body 38.

Thus, the entire storage bin inside the drawer part 32 has a metallic texture. A cool temperature may be evenly maintained in the storage bin and food in the storage bin may be evenly cooled. Furthermore, an excellent appearance may be provided, and excellent cooling and storing performance may be provided.

The drawer cover 37 includes: a cover front portion 371 dividing the inside of the drawer main body 38 into the front space S1 and the rear space S2; and a cover upper portion 372 being perpendicular to the upper end of the cover front portion 371 and shielding the rear space S2 from above.

That is, when mounting the drawer cover 37, with respect to the inside of the drawer main body 38, only the front space S1 (where the lifting unit 80 is disposed) is exposed, and the rear space S2 is shielded by the drawer cover 37.

The lifting unit 80 (or lifting mechanism) is provided inside the drawer main body 38. The lifting unit 80 has a structure connected to the driving unit 40 so as to be elevated and lowered in a manner that left and right sides are balanced.

The drawer holes 35 are formed in a lower portion of the front surface of the drawer part 32 in order to combine the lifting unit 80 and the driving unit 40.

The lifting unit 80 may be configured in a scissor lift structure, wherein the lifting unit 80 is folded in a lowered state and unfolded in an elevated state such that the container or food seated on an upper surface thereof can be raised.

The lifting unit 80 includes a support plate 81, and the support plate 81 provides a surface where the container 36 or food is seated.

The drawer holes 35 are located underneath the upper end of the lifting unit 80 (i.e., an upper surface of the support plate 81). Thus, in the example that the lifting unit 80 is mounted, the drawer holes 35 may be prevented from being seen inside the drawer part 32.

The support plate 81 has a size and a shape corresponding to the front space to prevent foreign matter from entering to the lifting unit 80 provided below the front space S1 and to block access to the lifting unit 80 to fundamentally prevent a safety accident.

Figure 14:
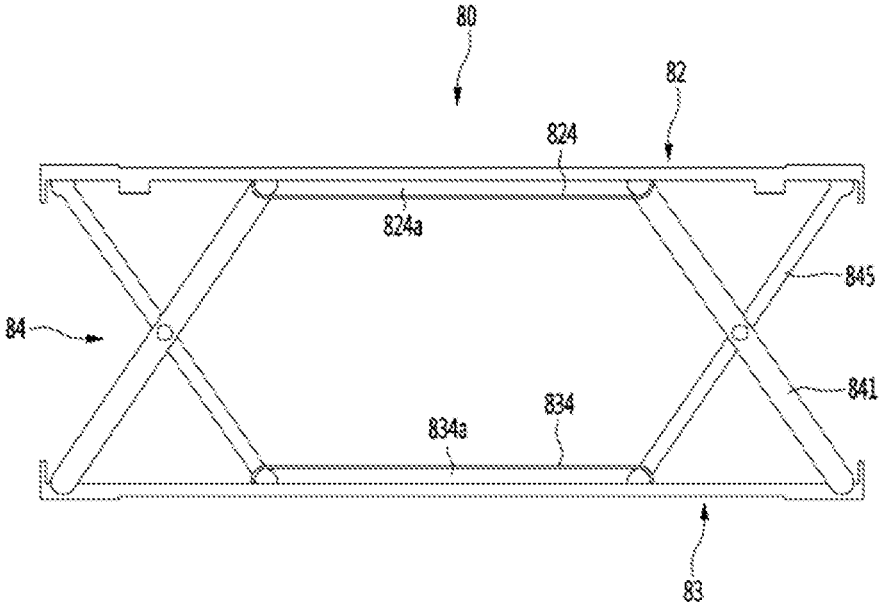
FIG. 14 is a view illustrating an upper frame of the lifting unit being elevated.
Figure 15:
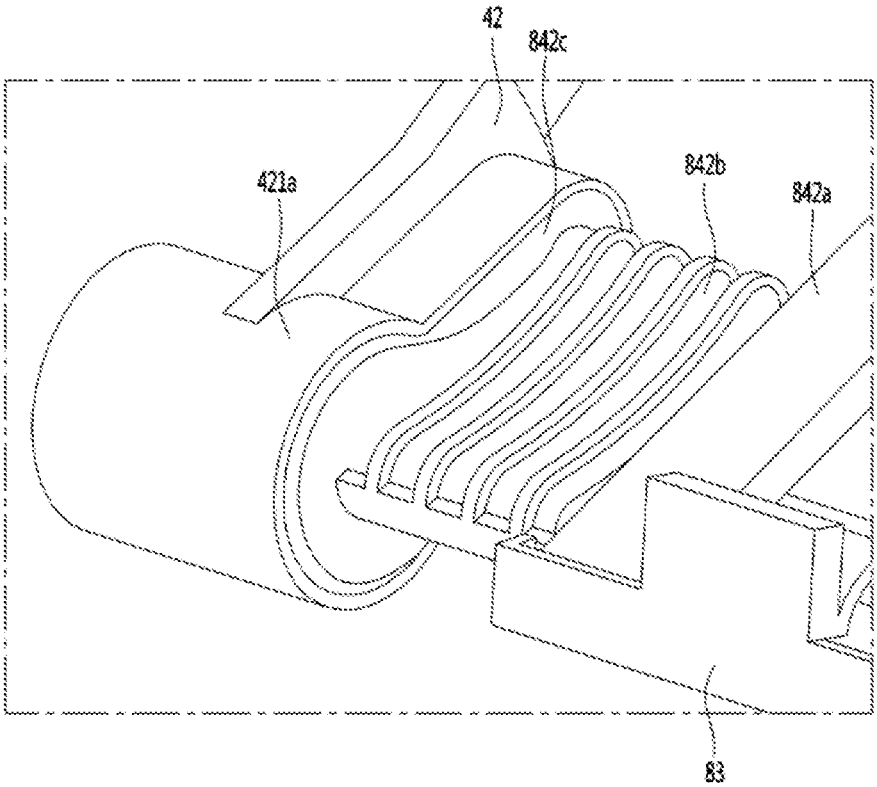
FIG. 15 is a view illustrating a lever according to the present disclosure being connected with the lifting unit.

FIG. 13 is a perspective view illustrating the lifting unit according to an example embodiment of the present disclosure. FIG. 14 is a view illustrating an upper frame of the lifting unit being elevated. FIG. 15 is a view illustrating a lever according to the present disclosure being connected with the lifting unit.

Referring to FIGS. 13 to 15, the lifting unit 80 is provided at the bottom of the inner surface of the drawer part 32, and is provided inside the drawer part 32 in a detachable manner.

The lifting unit 80 includes an upper frame 82, a lower frame 83, and scissor assemblies 84 disposed between the upper frame 82 and the lower frame 83.

The upper frame 82 is configured in a quadrangular shape corresponding to a size of the front space S1 of the drawer part 32, and the support plate 81 is seated on an upper surface thereof.

The upper frame 82 is a component of the lifting unit 80 that moves up and down and substantially supports food or the container 36 with the support plate 81.

The upper frame 82 includes a frame portion 821 configuring a periphery of the upper frame 82 and a partition portion 822 dividing an inner space of the frame portion 821 to left and right sides.

Since the frame portion 821 and the partition portion 822 are configured to shape an outline and to support the support plate 81, a high strength may be needed. Accordingly, the frame portion 821 and the partition portion 822 may be made of a metal material, and formed in a shape in which opposite ends are bent in order to increase strength and prevent deformation.

A slide guide 824 is provided on a lower side surface of the frame portion 821. The slide guide 824 accommodating ends of the scissor assemblies 84 to guide the scissor assemblies 84 to move.

The respective scissor assemblies 84 are disposed in opposite spaces 823 and 824 with respect to the partition portion 822.

The slide guide 824 is configured with a long hole 824*a* into which the scissor assemblies 84 are inserted. Thus, the scissor assemblies 84 move along the slide guide 824.

The lower frame 83 and the upper frame 82 may have the same or a similar structure but are installed to count to each other.

The lower frame 83 includes a frame portion and a partition portion. A slide guide 834 is provided on an upper surface of the lower frame 83, and the slide guide 834 accommodating ends of the scissor assemblies 84 to guide the scissor assemblies 84 to move.

The slide guide 834 is configured with a long hole 834*a* into which the scissor assemblies 84 are inserted. Thus, the scissor assemblies 84 move along the slide guide 834.

The respective scissor assemblies 84 are provided on the left and right sides and operate by receiving power from the single lifting motor 64. Thus, the scissor assemblies 84 can be raised by the same height at the same height.

Therefore, even when supporting heavy loads, a pair of scissor assemblies 84 which are applied power independently on each side may lift the heavy loads effectively. The scissor assemblies 84 can be raised while the upper frame 82 (i.e., the support plate 81) maintains a horizontal state.

Each of the scissor assemblies 84 includes a first scissor frame 841 having a quadrangular shape and a second scissor frame 845 having a quadrangular shape and rotatably connected with the first scissor frame 841.

The second scissor frame 845 may have a width smaller than the first scissor frame 841. Thus, the second scissor frame 845 is connected with the first scissor frame 841 while being located in a region defined by the first scissor frame 841.

Figure 24:
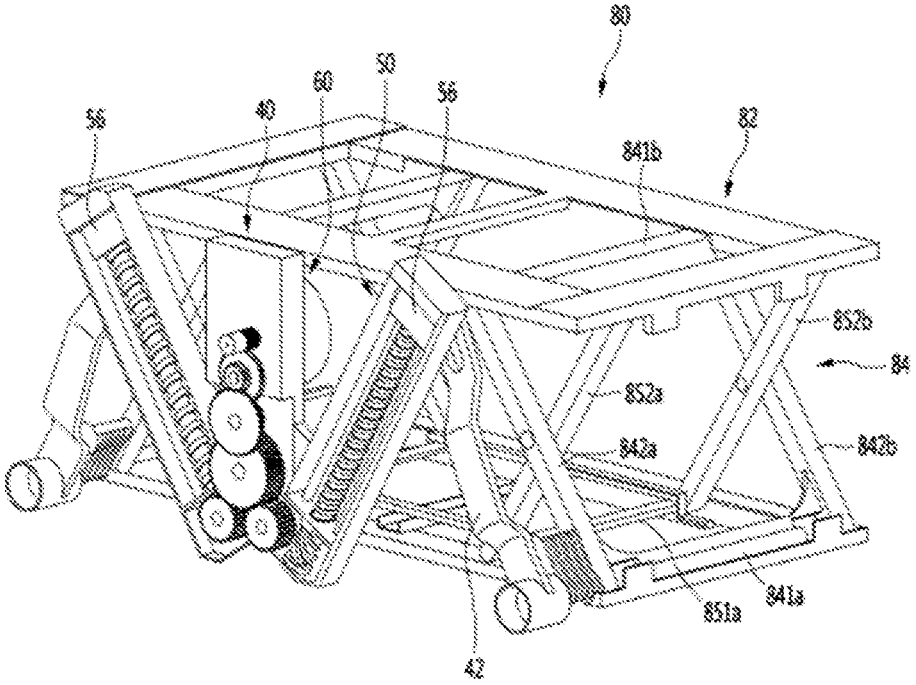
FIG. 24 is a perspective view illustrating the driving unit and the lifting unit in the state illustrated in FIG. 23.

The first scissor frame 841 includes a lower shaft (see FIG. 24 showing reference numeral 841*a*) and an upper shaft (see FIG. 24 showing reference numeral 841*b*) extending in the horizontal direction.

The lower shaft is supported by the lower frame 83 in a rotatable manner, and the upper shaft is disposed to penetrate the slide guide 824 of the upper frame 82.

The first scissor frame 841 is connected to a first rod (see FIG. 24 showing reference numeral 852*a*) extending in a longitudinal direction and the upper shaft (see FIG. 24 showing reference numeral 841*b*).

The second scissor frame 845 includes a lower shaft 851*a* and an upper shaft extending in the horizontal direction and a first rod 852*a* and a second rod 852*b* extending in each longitudinal direction.

The first rod 842*a* of the first scissor frame 841 includes an extension portion 842*b* protruding to connect with one of the levers 42 and includes the engaging portion 842*c* provided at the end of the extension portion 842*b*.

Each of the levers 42 includes the accommodating portion 421*a* accommodating the engaging portion 842*c* to be engaged with the engaging portion 842*c*.

The end of the engaging portion 842*c* may be non-circular. When the lever 42 rotates while the accommodating portion 421*a* accommodates the engaging portion 842*c*, the lever 42 may be prevented from slipping in the engaging portion 842*c*.

The engaging portion 842*c* and the extension portion 842*b* pass through each of the drawer holes 35, and the extension portion 842*b* is positioned inside each of the drawer holes 35. Therefore, the lifting unit 80 (inside the drawer part 32) is connected to the driving unit 40 (disposed outside the drawer part 32) by the extension portion 842*b* and the engaging portion 842*c*.

The drawers 30 of the refrigerator 1 according to at least one embodiment of the present disclosure having the above-described structure may be described in detail about opening, closing, and raising operation with reference to the accompanying drawings.

Figure 16:
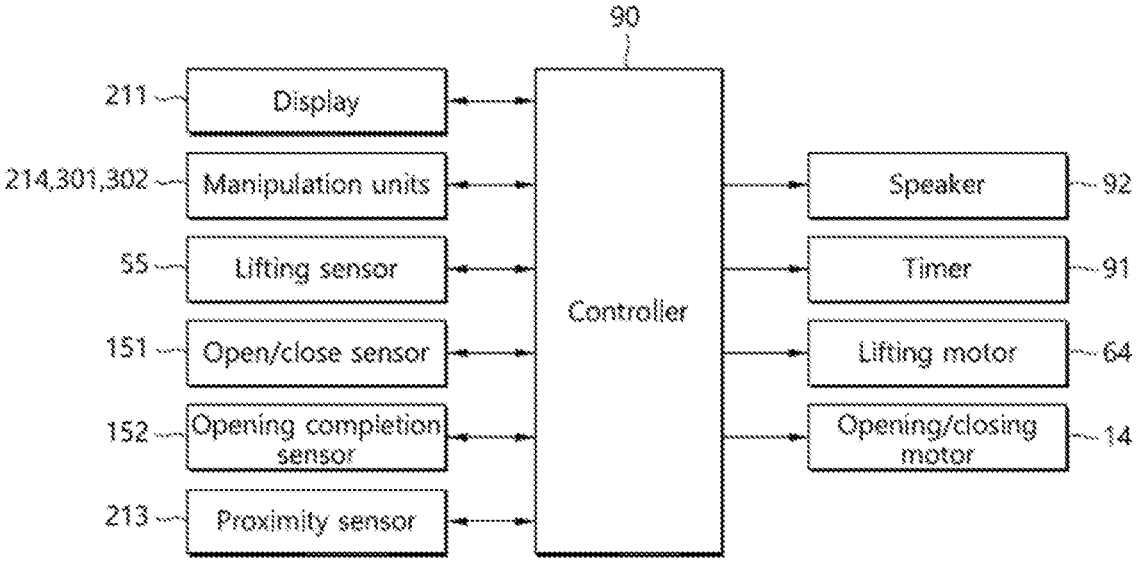
FIG. 16 is a block diagram schematically illustrating connections between a controller and components connected to the controller according to an example embodiment of the present disclosure.
Figure 17:
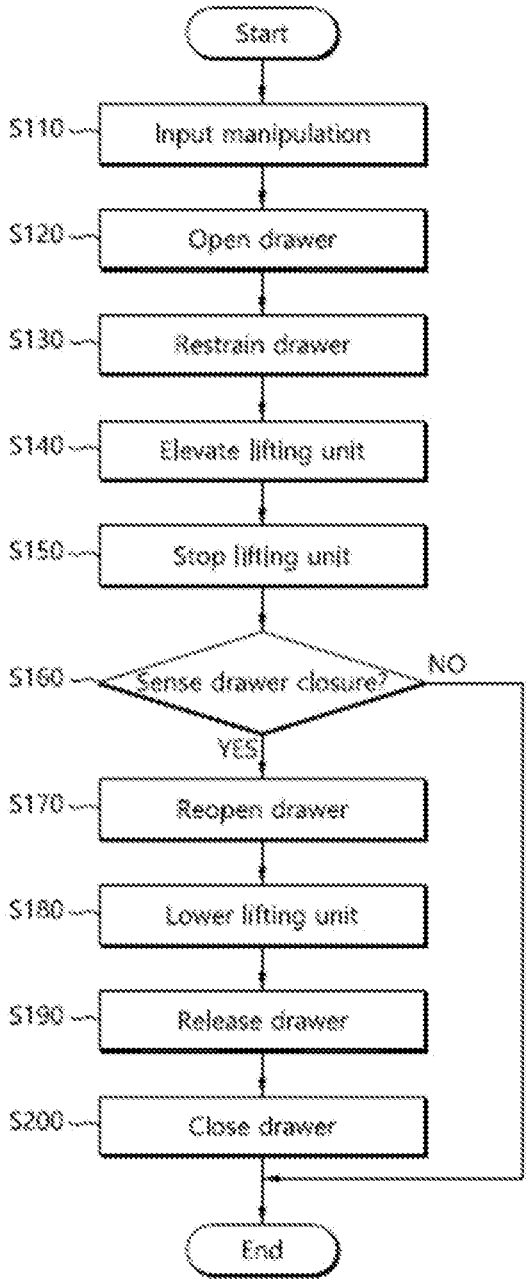
FIG. 17 is a flowchart illustrating a control method for a refrigerator according to opening, closing, and raising of the drawer.

FIG. 16 is a block diagram schematically illustrating connections between a controller and components connected to the controller according to an example embodiment of the present disclosure. FIG. 17 is a flowchart illustrating opening, closing, and raising operations of the drawer. FIGS. 18 to 26 are views each illustrating a state of the drawer in opening, closing, and raising operations of the drawer. Other embodiments and configurations may also be provided.

Figure 18:
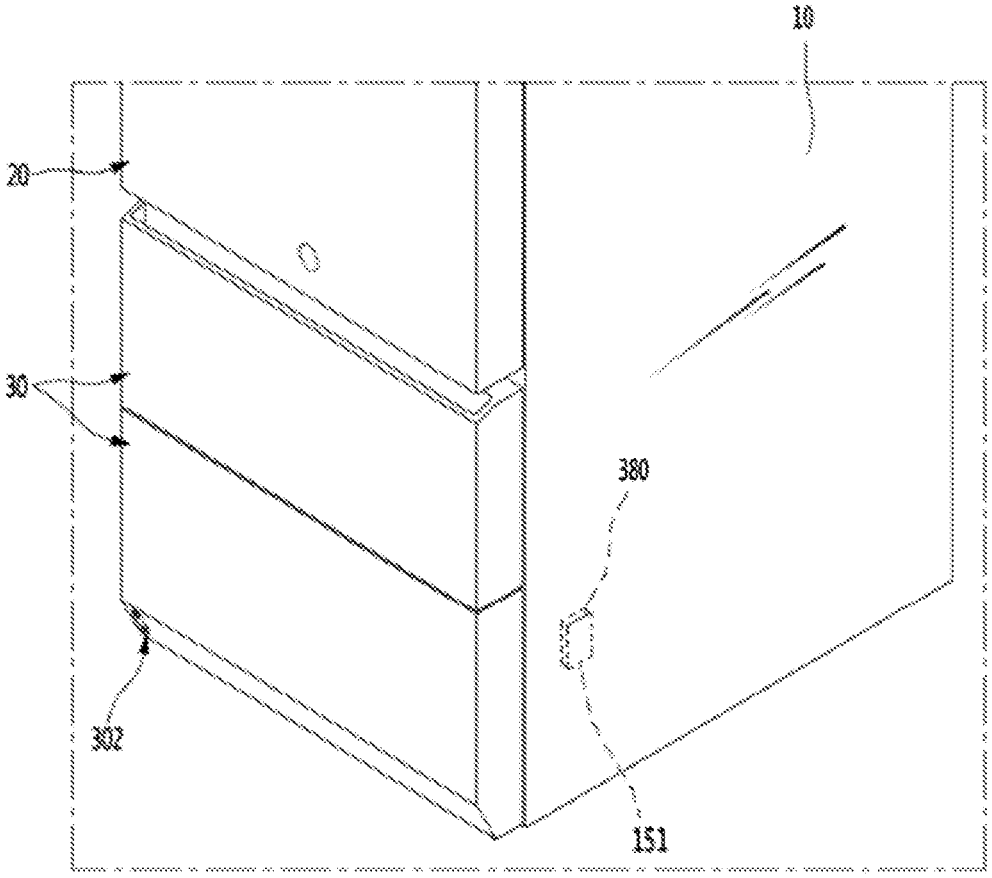
FIG. 18 is a perspective view illustrating the drawer closed.

While the refrigerator 1 stores food, all of the swinging door 20 and the drawers 30 are closed as shown in FIG. 18. In this state, a user may open and close the drawers 30 to store food.

The multiple drawers 30 may be provided in a vertical direction. The lower drawer of the drawers 30 is disposed to be adjacent to the upper drawer, and may have no handle for opening and closing. In other words, a gap between the upper drawer and the lower drawer is almost invisible so that the front exterior of the refrigerator 1 look neat and luxurious.

The opening and closing of the drawer 30 may be detected by the open/close sensor 151 (or sensor) provided inside the cabinet 10. When the open/close sensor 151 detects the magnet 380 provided on one side surface of the drawer 30 while the drawer 30 is closed, the drawer 30 is determined to be closed. When the magnet 380 is not detected, the drawer 30 is determined to be open.

The open/close sensor 151 may detect whether the opening of the drawer 30 starts and the closing of the drawer 30 is completed. While the open/close sensor 151 detects the magnet 380, when the magnet 380 is not detected anymore, the opening of the drawer 30 is determined to have started. From a state where the magnet 380 is not detected, when the magnet 380 starts to be detected, the closing of the drawer 30 is completed.

To open and close the lower drawer, the user may manipulate the manipulation unit (or input device) so that a signal for opening and closing of the drawer is input. The user may provide an input at the input device.

The user can manipulate the multiple manipulation units 214, 301, and 302 (or multiple input devices) to operate the drawer 30. When manipulating the manipulation units 214, 301, and 302, the first proximity sensor 213 may detect proximity of the user.

The opening of the drawer 30 may be started after it is determined that the manipulation input is valid only when one of the manipulation units 214, 301, and 302 is manipulated in a state where proximity of the user is recognized by the first proximity sensor 213.

For example, when the user stands in front of the refrigerator 1 and manipulates the first manipulation unit 214, the first proximity sensor 213 may generate a signal notifying that proximity of the user is detected, and the first manipulation unit 214 may generate a manipulation signal of the user. Therefore, the controller 90 determines that the manipulation input is valid for operation of the drawer 30 and allows the opening of the drawer 30 to start.

When the first proximity sensor 213 does not detect proximity of the user or a manipulation is not input to one of the manipulation units 214, 301, and 302, the drawer 30 is not opened. [S110: Input Manipulation step]

The controller 90 that controls the overall operation of the refrigerator 1 controls the opening/closing motor 14 to operate the opening/closing motor 14 when it is determined in the manipulation inputting step that the manipulation input is valid.

When the opening/closing motor 14 is driven or controlled by the controller 90, the drawer 30 is opened forward. The drawer 30 may be opened as the rails 33 extend.

The racks 34 provided on the bottom surface of the drawer 30 are combined with the pinion gears 141 rotating when the opening/closing motor 14 provided in the cabinet 10 operates, and the drawer 30 is opened and closed according to operation of the opening/closing motor 14.

Figure 20:
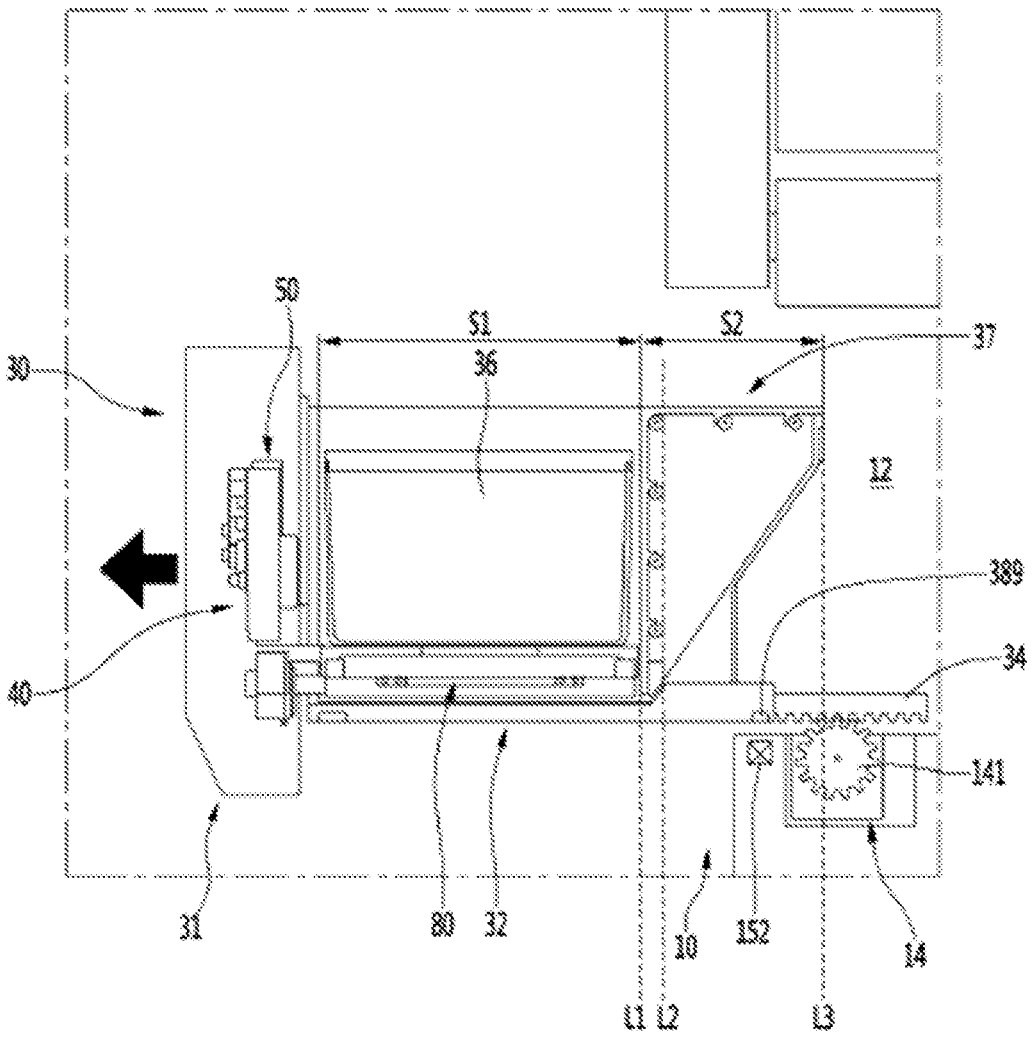
FIG. 20 is a cross-sectional view illustrating the drawer part in the state illustrated in FIG. 19.

The drawer 30 may be opened as much as shown in FIGS. 19 and 20. A pushing-out distance of the drawer 30 may be a distance that at least the front space S1 (inside the drawer part 32) can be fully exposed to the outside. Therefore, as shown in FIGS. 19 and 20, when the drawer 30 is fully opened, the container or food is not interfered with the doors 20 and 30 disposed above or the cabinet 10 when the lifting unit 80 is elevated.

The state where the drawer 30 is opened may be described in detail. In the state (or example) where the drawer 30 is opened for raising, the front space S1 is to be fully opened out of the lower storage space 12.

A rear end L1 of the front space S1 is to be ahead of the cabinet 10 or a front end L2 of the swinging door 20 by opening the drawer in order to prevent interference of the cabinet 10 and the swinging door 20 when the lifting unit 80 is elevated.

As shown in FIG. 20, the drawer 30 may not be fully opened such that the drawer part 32 is not exposed entirely, but may be opened to a position for avoiding interference when the lifting unit 80 is elevated. The rear space S2 of the drawer part 32 is partly positioned inside the lower storage space 12. That is, a rear end L3 of the drawer part 32 is positioned inside the lower storage space 12.

Thus, even with weight of the container or food in addition to weight of the drawer 30 itself including weight of the driving unit 40 and the lifting unit 80, stable opening, closing, and raising may be ensured without any sagging or damage of the rails 33 or the drawer 30.

When the drawer 30 is fully opened, that is, the completion of opening of the drawer 30 is detected by an opening completion sensor 152 disposed in the cabinet 10 and the drawer 30. The opening completion sensor 152 may detect that the drawer 30 starts to be closed from the state where the opening of the drawer 30 is completed.

The opening completion sensor 152 may be a sensor for detecting a magnet 389 provided on one side of the drawer part 32 such as the racks 34 and the rails 33 to detect the state where the drawer 30 is fully opened.

For example, as shown in the drawings as an example, the magnet 389 may be provided on the rails 33 of the drawer part 32, and the opening completion sensor 152 may be provided on the bottom surface of the cabinet 10.

The opening completion sensor 152 is provided at a position corresponding to a position of the magnet 389 in a state where the drawer 30 is fully opened. Accordingly, the state where the drawer 30 is fully opened (i.e., the completion of opening of the drawer 30) is determined by the opening completion sensor 152.

When the drawer 30 is moved and starts to be closed from the state where the drawer 30 is fully opened (completion of opening), the magnet 389 also moves together with the drawer. At this point, the opening completion sensor 152 does not detect the magnet 389 anymore, and the drawer 30 is determined to start to be closed. That is, from the state where the opening completion sensor 152 detects the magnet 389, when the magnet 389 is not detected anymore, the drawer 30 is determined to start to be closed.

The magnet 389 may be provided on the racks 34. In this example, the opening completion sensor 152 is provided at a position corresponding to a position of the magnet 389 in a state where the drawer 30 is fully opened. Accordingly, the state where the drawer 30 is fully opened (i.e., the completion of opening of the drawer 30) is determined by the opening completion sensor 152.

Switches may be provided at a position where the drawer 30 is fully closed and opened to detect the opening and closing of the drawer 30. Alternatively, the drawer 30 may be detected by counting the number of revolutions of the opening/closing motor 14, by using a sensor detecting a distance between the rear surface of the front panel 31 and the front end of the cabinet 10, or by measuring time at which the drawer 30 is opened or closed.

When the opening completion sensor 152 detects that the drawer 30 is opened to a set distance, the controller 90 determines that the opening of the drawer 30 is completed, and stops driving of the opening/closing motor 14 to end the opening of the drawer 30. [S120: Open Drawer step]

In the state where the drawer 30 is fully opened, the opening/closing motor 14 may be braked (or stopped) so as to not rotate anymore. That is, the drawer 30 is to maintain the opened state while the lifting unit 80 provided inside the drawer 30 is operating.

The opening/closing motor 14 may be embodied by a motor (e.g. a braking motor or a brake motor) equipped with a brake capable of selectively restraining the motor.

For example, when the drawer 30 is moved or closed while the lifting unit 80 is operating, there is a possibility of a safety accident. When the drawer 30 is moved or closed while the lifting unit 80 is operating, food in the storage may fall or be damaged, and a lifting structure or the refrigerator itself may be damaged.

The drawer 30 is to maintain a fixed state where the opening and closing of the drawer 30 is impossible even when an external force is applied, at least while the lifting unit 80 is operating.

The opening/closing motor 14 may be prevented from rotating due to a braking structure thereof even when an external force is applied. The opened state of the drawers 30 may be maintained by restraining the drawers 30. [S130: Restrain Drawer step]

As shown in FIGS. 19 and 20, the driving unit 40 and the lifting unit 80 are not operated until the drawer 30 is fully opened, and the lifting unit 80 keeps the lowest state.

Figure 21:
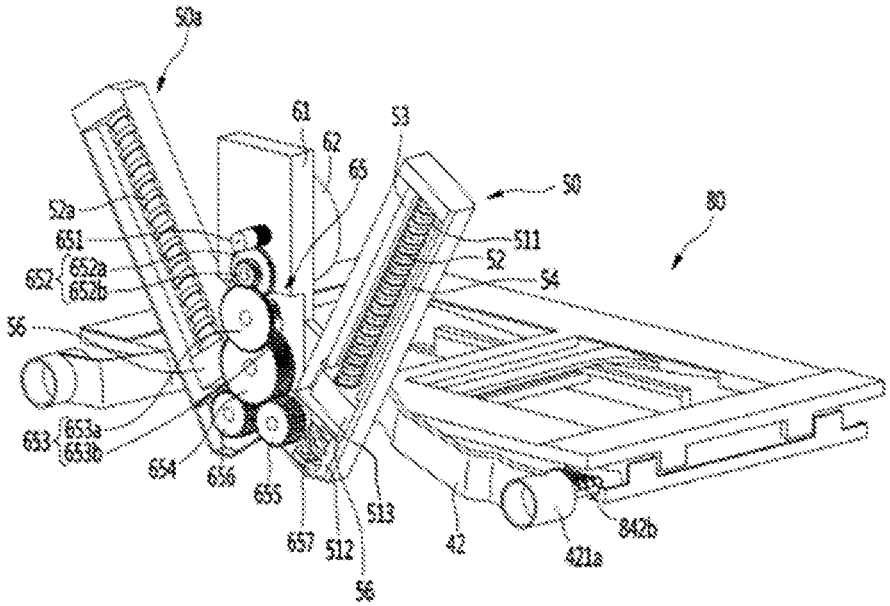
FIG. 21 is a perspective view illustrating the driving unit and the lifting unit in the state illustrated in FIG. 19.

As shown in FIG. 21, the levers 42 and the screw holders may be positioned at the lowest positions before the lifting unit 80 is elevated, and the lifting sensor 55 may detect this and determine that the present state is a state where the lifting unit 80 is fully lowered.

In the state in which the lifting unit 80 is fully lowered, the screw holder **56*a* is positioned at the lowest position. At this point, the magnet 563 provided on the screw holder 56*a* is positioned corresponding to a position of a sensor 553 of the pair of sensors 552 and 553 which is located below the other one. Thus, the sensor 553 which is the lower one detects the magnet 563 so that it is determined that the lifting unit 80** is fully lowered.

When it is determined that the lifting unit 80 is fully lowered by detection of the lifting sensor 55, the driving unit 40 starts the operation after the user manipulates or the drawer 30 is fully opened.

When it is determined that the lifting unit 80 is not fully lowered by detection of the lifting sensor 55, an abnormal signal is output and thus the driving unit 40 is not operated.

Figure 22:
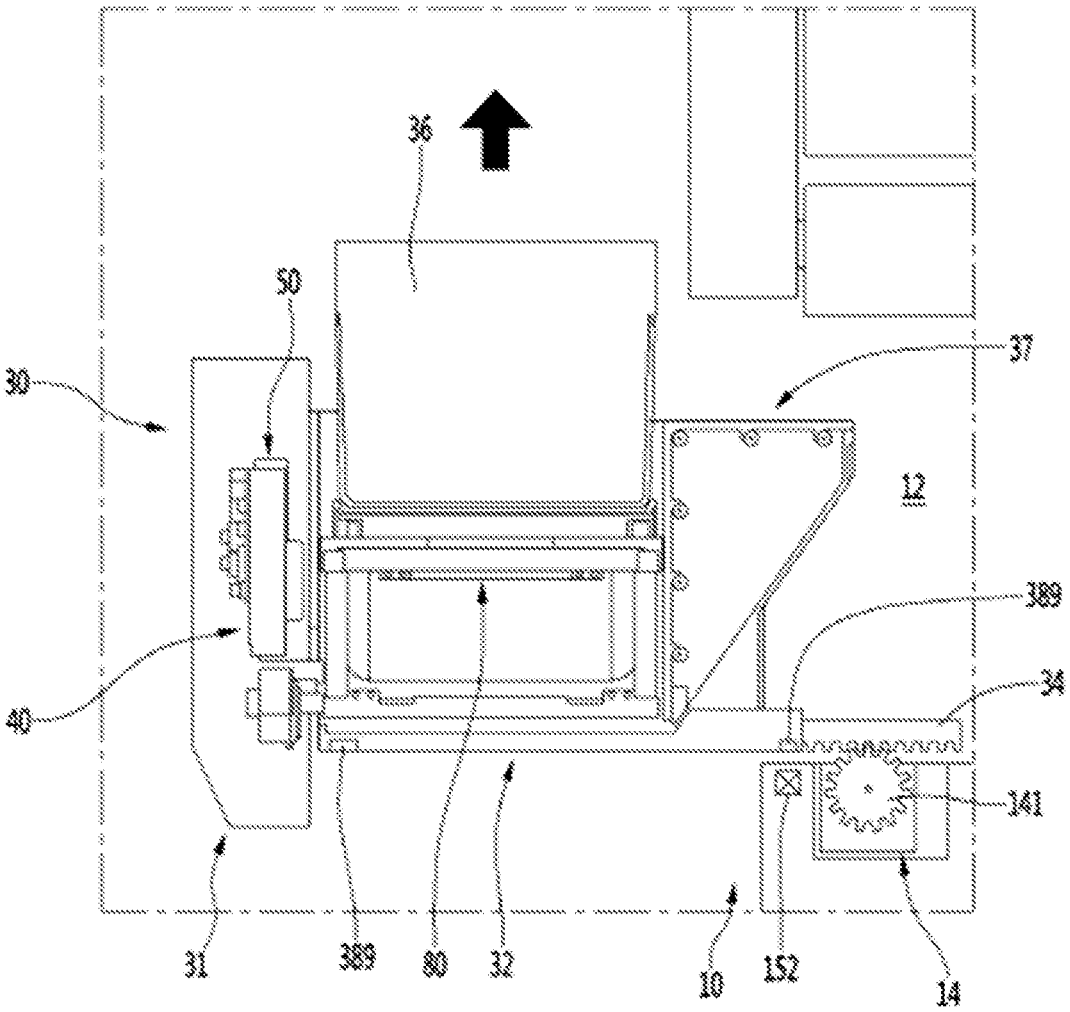
FIG. 22 is a cross-sectional view illustrating the drawer part while the lifting unit is elevated.

When the drawer 30 is opened to a set distance, the controller 90 may direct or control the lifting motor 64 to operate. The driving unit 40 may then operate by the lifting motor, and the lifting unit 80 is elevated as shown in FIG. 22.

In the state where the drawer 30 is fully opened and the opening/closing motor 14 stops, the lifting motor 64 is operated by the controller 90. The lifting unit 80 is configured to operate only in a circumstance where the drawer 30 is sufficiently opened such that safe lifting of food or the container 36 seated on the lifting unit 80 is ensured.

That is, the lifting unit 80 is operated in a state where the drawer 30 is opened and thus the front space S1 is fully exposed to the outside so that the container 36 or stored food seated on the lifting unit 80 is not interfered by other doors 20 and 30 or the cabinet 10.

In order to secure safety of the user and prevent damage to the stored food, the lifting unit 80 may be configured to start operation after it is ensured that the drawer 30 is opened and then a set time is elapsed.

In this embodiment, elevation of the lifting unit 80 means that the scissor assemblies 84 raise the upper frame 82, and the lowering of the lifting unit 80 means that the scissor assemblies 84 lowers the upper frame 82.

The driving unit 40 is connected to the lifting unit 80, and thus power can be transmitted to the lifting unit 80. As the driving unit 40 starts to operate, power is transmitted to the lifting unit 80, and the lifting unit 80 starts to be elevated.

When the lifting motor 64 rotates or rotates reversely according to a signal commanding raising or lowering of the lifting unit 80, the driving unit 40 starts to operate. The multiple gears between the lifting motor 64 and the screws 52 and 52*a* are rotated by operation of the lifting motor 64, and thus the screws 52 and 52*a* are rotated. As the screws 52 and 52*a* rotate, the screw holders 56 and 56*a* are raised and thus the levers 42 are rotated.

When the levers 42 are moved upward, the levers 42 gain height, and thus first rods 842*a* of the first scissor frames 841 connected to the levers 42 also gain height. In addition, as the first rods 842*a* of the first scissor frames 841 gain height, the scissor assemblies 84 can be unfolded.

Accordingly, as the scissor assemblies 84 are unfolded, the upper frame 82 is raised, and the container 36 or food seated on the support plate 81 are raised. As a result, the lifting unit 80 is elevated to the maximum height as shown in FIG. 23.

Figure 23:
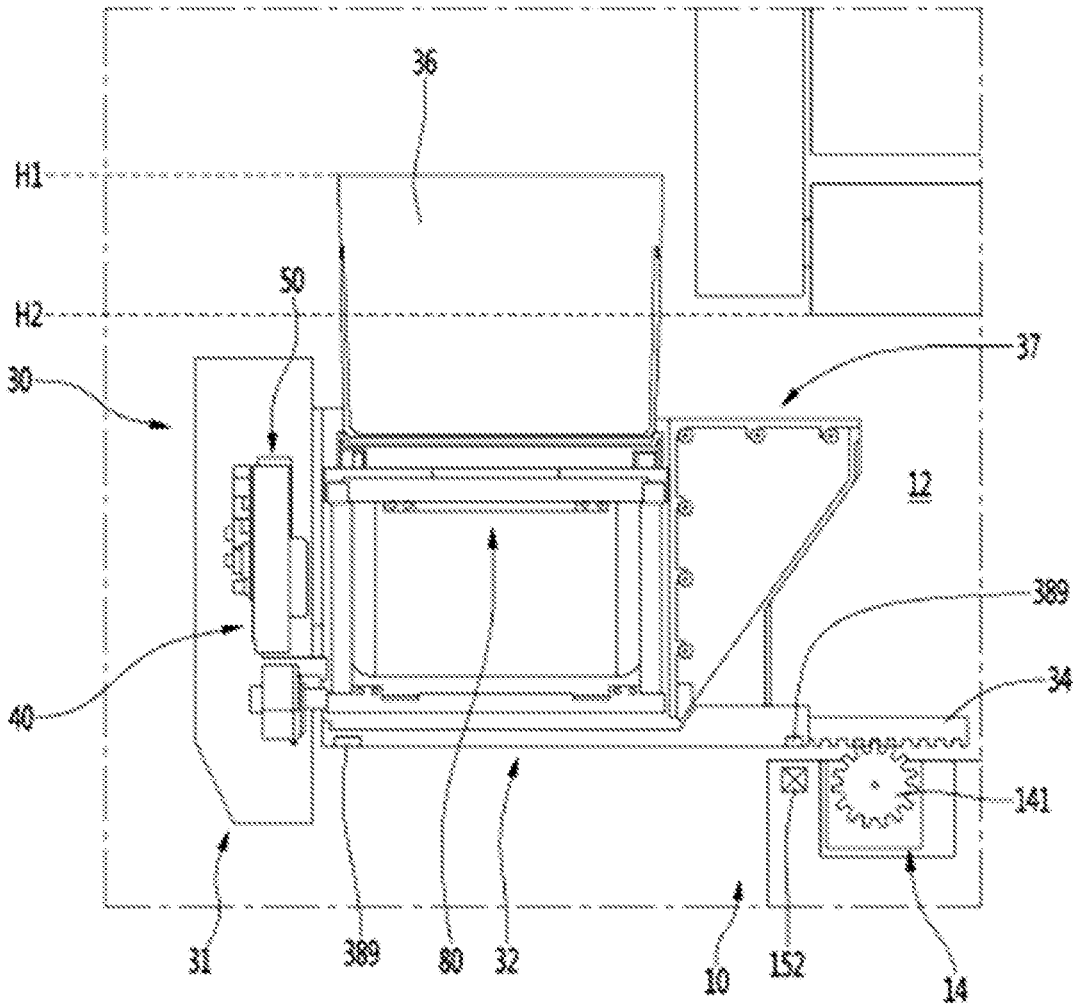
FIG. 23 is a cross-sectional view illustrating a state of the drawer part while the lifting unit is fully elevated and on standby.

As shown in FIG. 23, the lifting unit 80 stops when elevated enough to access food or the container 36 seated on the lifting unit 80. In this state, it is easy to lift food or the container 36 without excessively bending over. [S140: Elevate Lifting unit step]

The levers 42 and the screw holders are positioned at the highest positions when the elevating of the lifting unit 80 is completed, and the lifting sensor 55 detects this and determines that the present state is a state where the lifting unit 80 is fully elevated.

When it is determined that the lifting unit 80 is fully elevated by the detection of the lifting sensor 55 as shown in FIG. 24, the lifting motor 64 stops. In this state, the lifting unit 80 is positioned inside the drawer part 32, but food or the container 36 seated on the lifting unit 80 can be positioned at a higher position than the opened upper portion of the drawer part 32, which allows easy access.

The user may not need to excessively bend over to the lift the container 36, thereby enabling safe and convenient work.

A state where the lifting unit 80 is elevated to the maximum may be described in detail with reference to FIG. 23. The lifting unit 80 may positioned at a position lower than the top end of the drawer part 32.

With reference to a position of the container 36, the lifting unit 80 is elevated with the container 36 seated thereon to a position in which a top end H1 of the container 36 is higher than a top end H2 of the lower storage space 12 on the container 36. The height is a suitable height that the user can reach to lift the container 36 without bending down.

Although the lifting unit 80 has the structure to be elevated from the inside of the drawer part 32, the lifting unit 80 can be positioned at a height that allows easy access to the container 36 when the container 36 is seated thereon. [S150: Stop Lifting Unit step]

When the lifting unit 80 reaches the set height and the elevation of the lifting unit 80 is completed, the lifting sensor 55 detects that the elevation of the lifting unit 80 is completed.

At this point, from the state where the elevation of the lifting unit 80 is completed as described above, the drawer 30 can be closed. Although an additional manipulation of the user is not input in the state where the elevation of the lifting unit 80 is completed, for example, the drawer 30 may be closed by pushing the drawer 30 manually or by other factors When the drawer 30 is closed from the state where the elevating of the lifting unit 80 is completed as described above, the opening completion sensor 152 may detect that the drawer 30 starts to be closed. [S160: Sense Drawer Closure step]

When the drawer 30 is closed from the state where the elevating of the lifting unit 80 is completed, the drawer 30 may collide with the upper drawer 30 or the swinging door 20. Therefore, a process is needed to prevent collision with other doors in case the drawer 30 is closed by the user or by other factors while the elevation of the lifting unit 80 is completed.

In this embodiment, as the drawer 30 starts to be closed in the state where the elevating of the lifting unit 80 is completed, the opening completion sensor 152 may detect that the drawer 30 starts to be closed. The opening/closing motor 14 may then operate to reopen the drawer 30. To reopen the drawer may mean to open the drawer to the opening completion position.

That is, when the closing of the drawer 30 is detected in the state where the elevating of the lifting unit 80 is completed, the opening/closing motor 14 may operate to move the drawer 30 in the opening direction, and thus the drawer 30 is opened thereby. [S170: Reopen Drawer step]

At the drawer reopening step, when the opening completion sensor 152 detects that the drawer 30 starts to be closed, the closing of the drawer 30 may be restrained if necessary.

When the drawer 30 starts to be closed, the drawer 30 itself may be restrained so that the drawer 30 is no longer closed and collision with other doors may be prevented.

When the drawer 30 is restrained at the drawer reopening step, the opening/closing motor 14 may be controlled to operate to open the drawer 30 after releasing the drawer 30.

The drawer 30 may be fully opened at the drawer reopening step. That is, the drawer 30 may be opened until the opening completion sensor 152 detects that the opening of the drawer 30 is completed.

When the opening completion sensor 152 detects that the opening of the drawer 30 is completed, operation of the opening/closing motor 14 may be stopped.

A notification of the above-described reopening of the drawer 30 may be output. In this embodiment, the notification of reopening of the drawer may be shown on the display 211 or output through a speaker 92 in the form of sound. This may allow the user to visually and audibly recognize the reopening of the drawer 30.

At the drawer reopening step, the opening/closing motor 14 may automatically operate when the opening completion sensor 152 detects that the drawer 30 starts to be closed even without any additional manipulation of the user in the state where the elevation of the lifting unit 80 is completed.

Although not shown in the drawings, the drawer reopening step may be performed not only in the state where the elevation of the lifting unit 80 is completed but also in a state where the lifting unit 80 is being elevated or lowered. That is, when the drawer 30 starts to be closed, the drawer 30 can be reopened as described above even when the lifting unit 80 is being elevated.

In another embodiment, the drawer 30 may be opened when a predetermined time counted by a timer 91 is elapsed while the lifting unit 80 is being elevated or the elevation is completed or open the drawer 30 by manipulating one of the manipulation units 214, 301, and 302.

As described above, when the reopening of the drawer 30 is completed, the opening completion sensor 152 detects that the opening of the drawer 30 is completed.

When the opening completion sensor 152 redetects (or detects) that the opening of the drawer 30 is completed, the lifting motor 64 may operate to lower the lifting unit 80.

Figure 25:
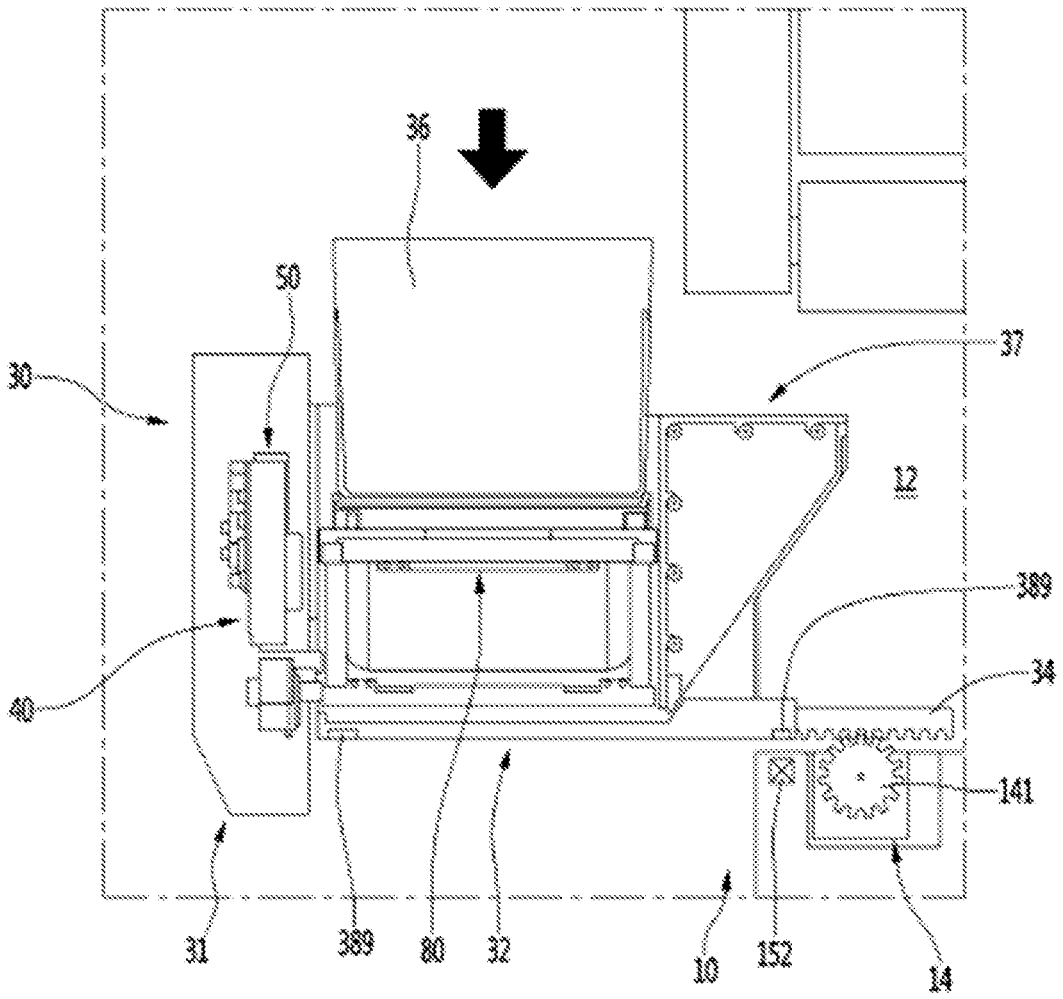
FIG. 25 is a cross-sectional view illustrating the drawer part while the lifting unit is lowered.

That is, when the opening completion sensor 152 redetects (or detects) that the opening of the drawer 30 is completed, the controller 90 controls to operate the lifting motor 64 and the lifting unit 80 starts to be lowered as shown in FIG. 25.

The lowering of the lifting unit 80 is made by reverse rotation of the lifting motor 64, and may be slowly performed through the reverse process with respect to the above-described elevation process of the lifting unit 80.

When the lowering of the lifting unit 80 is completed as shown in FIG. 20, the lifting sensor 55 may detect that the lowering of the lifting unit 80 is completed. That is, when the sensor 553 detects the magnet 563, the controller 90 determines that the lowering of the lifting unit 80 is completed and stops the operation of the lifting motor 64. [S180: Lowering Lifting Unit step]

The drawer reopening step and the lowering lifting unit step may be performed consecutively. The reopening of the drawer 30, the redetection of the completion of the opening of the drawer 30, and the lowering of the lifting unit 80 may proceed consecutively. As soon as the opening completion sensor 152 redetects (or controls) that the opening of the drawer 30 is completed, the lowering of the lifting unit 80 may proceed automatically.

When the controller 90 receives a signal in which the lowering of the lifting unit 80 is completed, the controller 90 stops operation of the lifting motor 64 and releases the opening/closing motor 14. The controller 90 may unbrake the opening/closing motor 14 or release the drawer 30 to prepare the drawer 30 to be closed. [S190: Release Drawer step]

That is, the controller 90 completely restrains the opening and closing of the drawer 30 until the lowering of the lifting unit 80 is completed so that the raising operation of the lifting unit 80 can be performed stably. The food storage can be easily and safely performed. When the controller 90 receives the signal in which the lowering of the lifting unit 80 is completed, the controller 90 stops operation of the lifting motor 64 and releases the restraint.

Figure 26:
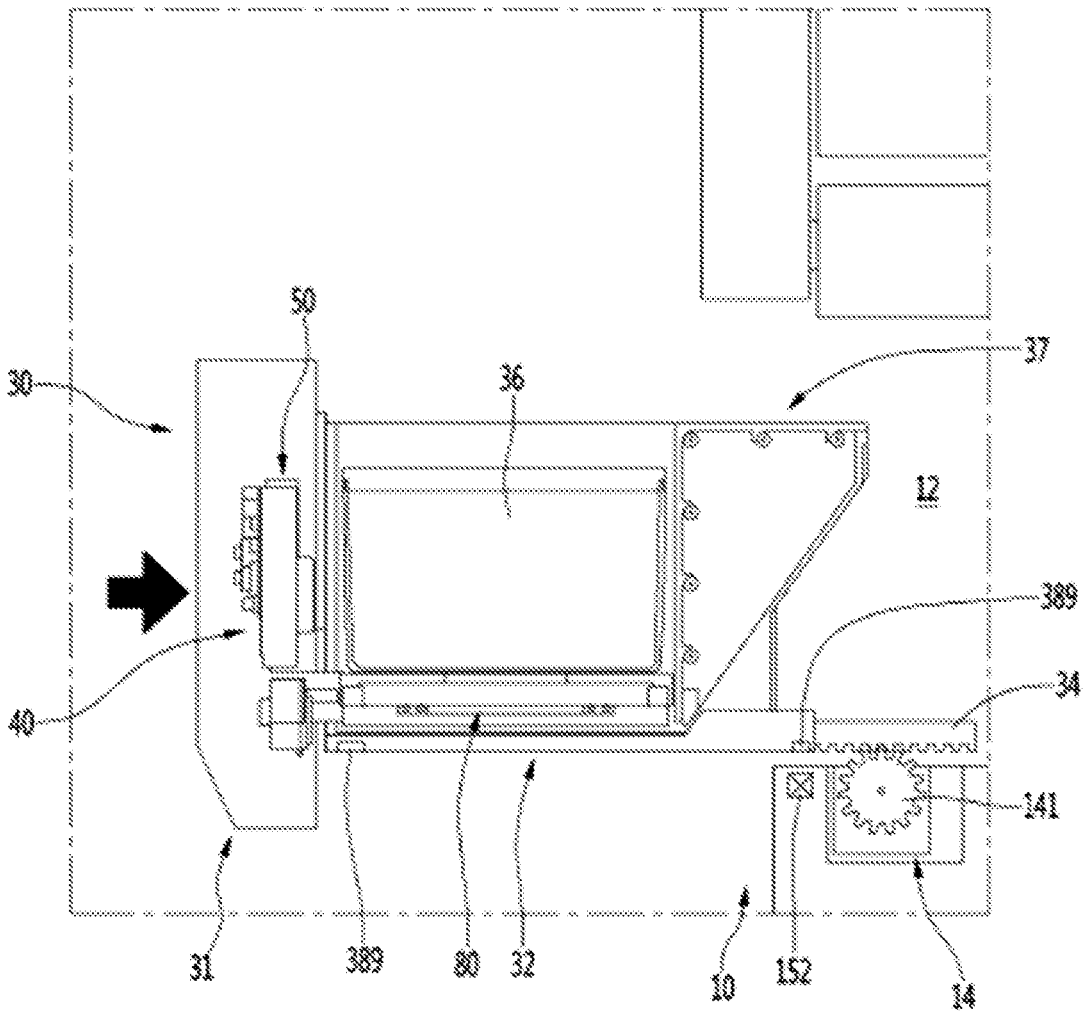
FIG. 26 is a cross-sectional view illustrating the drawer part while the drawer is being closed.

When the opening/closing motor 14 is released, the controller 90 directs (or controls) the opening/closing motor 14 to perform reverse rotation. By reverse rotation of the opening/closing motor 14, the drawer 30 can be closed as shown in FIG. 26. [S200: Close Drawer step]

The opening/closing motor 14 may perform reverse rotation until the drawer 30 is fully closed. As shown in FIG. 18, in the state where the drawer 30 is fully closed, the open/close sensor 151 detects that the closing of the drawer 30 is completed.

Stopping of the lifting motor 64 and the closing of the drawer 30 may proceed consecutively. That is, when the lifting unit 80 is fully lowered by operation of the lifting motor 64, the closing of the drawer 30 may proceed immediately after the lifting motor 64 stops. When the drawer 30 is restrained, the releasing of the drawer 30 may proceed consecutively.

The present disclosure may further include various other control methods in addition to the above-described control method. Hereinafter, various control methods for the refrigerator according to an embodiment of the present disclosure will be described.

Hereinbelow, other control methods for the refrigerator may be described in detail with reference to the drawings. Among steps of the control methods to be described below, the same steps as the above-described control method are denoted by the same reference numerals, and a detailed description thereof may be omitted. In addition, one or more following control methods may be combined.

Figure 27:
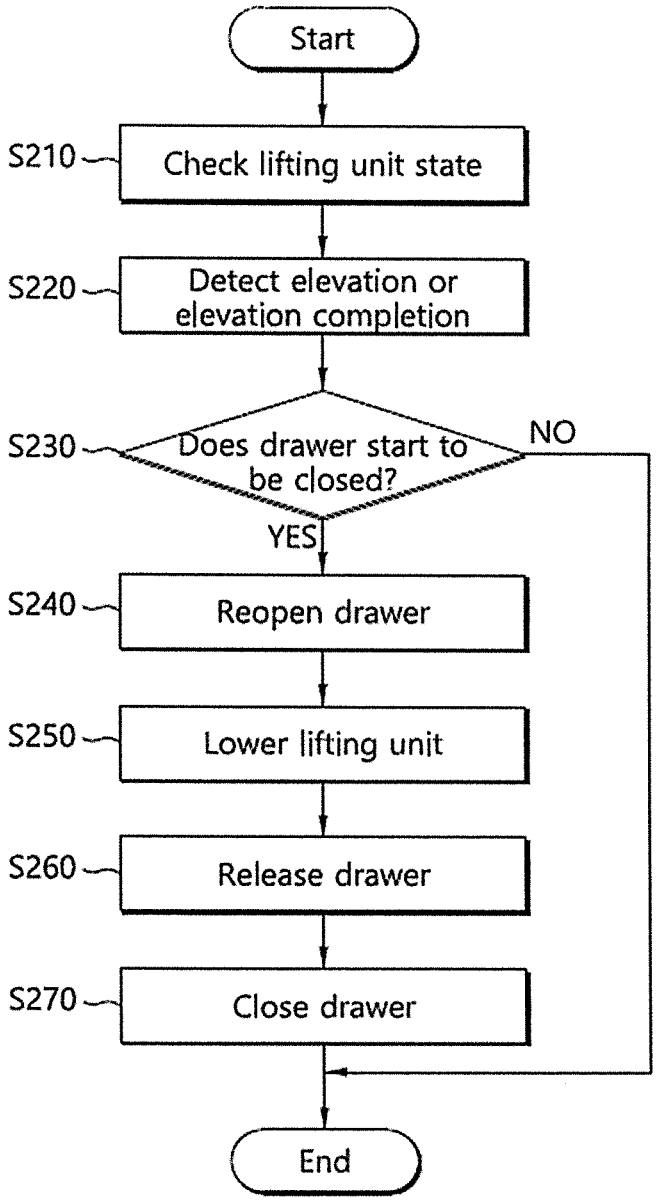
FIG. 27 is a flowchart illustrating a control method for the refrigerator according to an example embodiment of the present disclosure.

FIG. 27 is a flowchart illustrating a control method for the refrigerator according to an embodiment of the present disclosure.

Referring to FIG. 27, the controller 90 detects a state of the lifting unit 80. The lifting unit 80 may be provided (or shown) in various states while being elevated and lowered.

The lifting unit 80 may show an elevation state (or be provided in the state). As described above, when the drawer 30 is pushed out and opened according to the manipulation input of the user, the lifting unit 80 may start to be elevated. The elevation state may be a state between the time at which the elevation of the lifting unit 80 starts and the time at which the elevation of the lifting unit 80 is completed.

The lifting unit 80 may show a lowering state (or be provided in the state). As described above, after the manipulation input of the user or after the set time is elapsed, the lifting unit 80 may start to be lowered from the state where the lifting unit 80 is elevated. The lowering state may be a state between the time at which the lifting unit 80 starts to be lowered and the time at which the lowering of the lifting unit 80 is completed.

Furthermore, the lifting unit 80 may show an elevation completion state and a lowering completion state (or be provided in one or more of the states). The elevation completion state may be a state where the elevation of the lifting unit 80 is completed and thus the lifting unit 80 does not move, and the lowering completion state may be a state where the lowering of the lifting unit 80 is completed.

The states of the lifting unit 80 may be detected by the lifting sensor 55 as described above, and the lifting sensor 55 may transmit a signal including the state of the lifting unit 80 to the controller 90. [S210: Check Lifting Unit State step]

When the drawer 30 is open and the lifting unit 80 is being elevated or the elevation thereof is completed, the drawer 30 maintains the opened state. The completion of opening of the drawer 30 may be detected by the opening completion sensor 152. [S220: Detect Elevation or Elevation Completion step]

When the drawer 30 is closed without any additional manipulation input of the user while the lifting unit 80 is being elevated or the elevation thereof is completed, the lifting unit 80 may collide with other doors.

From the state where the drawer 30 is open and the lifting unit 80 is being elevated or the elevation thereof is completed, when the drawer 30 starts to be closed, the opening completion sensor 152 detects that the drawer 30 starts to be closed. [S230: Detect Drawer Start Closing step]

Thus, when the drawer 30 starts to be closed from the above state, opening the drawer 30, which starts to be closed may be used to prevent collision.

The controller 90 may allow the opening/closing motor 14 to perform reverse rotation in order to reopen the drawer 30

(i.e., to provide the drawer in the opening completion position). The opening/closing motor 14 preferably operates until the drawer 30 is fully opened.

When the opening completion sensor 152 redetects (or detects) that the opening of the drawer 30 is completed, operation of the opening/closing motor 14 is stopped, and reopening of the drawer 30 is completed. [S240: Reopen Drawer step]

When the opening completion sensor 152 redetects (or detects) that the opening of the drawer 30 is completed, the lifting motor 64 operates to lower the lifting unit 80.

That is, when the opening completion sensor 152 redetects (or detects) that the opening of the drawer 30 is completed, the controller 90 directs (or controls) to operate the lifting motor 64 and the lifting unit 80 starts to be lowered as shown in FIG. 25.

The lowering of the lifting unit 80 is made by reverse rotation of the lifting motor 64, and may be performed slowly through the reverse process with respect to the above-described elevation process of the lifting unit 80.

When the lowering of the lifting unit 80 is completed as shown in FIG. 20, the lifting sensor 55 detects that the lowering of the lifting unit 80 is completed. That is, when the sensor 553 detects the magnet 563, the controller 90 determines that the lowering of the lifting unit 80 is completed and stops the operation of the lifting motor 64. [S250: Lower Lifting Unit step]

The drawer reopening step and the lifting unit lowering step may be performed consecutively. The reopening of the drawer 30, the redetection of the completion of the opening of the drawer 30, and the lowering of the lifting unit 80 may proceed consecutively. As soon as the opening completion sensor 152 redetects that the opening of the drawer 30 is completed, the lowering of the lifting unit 80 proceeds automatically.

When the controller 90 receives a signal in which the lowering of the lifting unit 80 is completed, the controller 90 stops operation of the lifting motor 64 and release the opening/closing motor 14. The controller 90 may unbrake the opening/closing motor 14 or releases the drawer 30 to prepare the drawer 30 to be closed. [S260: Release Drawer step]

That is, the controller 90 may completely restrain the opening and closing of the drawer 30 until the lowering of the lifting unit 80 is completed so that the lifting operation of the lifting unit 80 can be performed stably. The food storage can be easily and safely performed. When the controller 90 receives the signal in which the lowering of the lifting unit 80 is completed, the controller 90 may stop operation of the lifting motor 64 and release the restraint.

When the opening/closing motor 14 is released, the controller 90 directs (or controls) the opening/closing motor 14 to perform reverse rotation. By reverse rotation of the opening/closing motor 14, the drawer 30 can be closed as shown in FIG. 26. [S270: Close Drawer step]

At the drawer closing step, the opening/closing motor 14 performs reverse rotation until the drawer 30 is fully closed. As shown in FIG. 18, in the state where the drawer 30 is fully closed, the open/close sensor 151 may detect that the closing of the drawer 30 is completed.

Although the embodiments of the present disclosure have been described with reference to the accompanying drawings, those skilled in the art will appreciate that various modifications, additions and substitutions are possible, without departing from the scope and spirit of the disclosure as disclosed in the accompanying claims. Therefore, the embodiments of the present disclosure are disclosed only for illustrative purposes and should not be construed as limiting the present disclosure.

As refrigerators become versatile and intelligent, the refrigerators become larger. Accordingly, the number of storage bins (or storage rooms) where food is stored is increased and thus electrical devices and machinery related to each storage bin may become complicated.

The drawer may be provided not only in a general household refrigerator but also in special-purpose apparatuses, for example, a kimchi refrigerator and a wine refrigerator.

Although this specification has described the drawer provided in a general household refrigerator as an example, the present disclosure is applicable to various apparatuses to which the drawer is applied.

Accordingly, the present disclosure has been made keeping in mind problems, and an objective of the present disclosure is to provide a refrigerator and a control method therefor in which opening, closing, and raising of a drawer is automatically performed according to a manipulation of a user.

Another objective of the present disclosure is to provide a refrigerator and a control method therefor in which the drawer is reopened when it is detected that the drawer is closed in a state where a lifting unit is being elevated or the elevation of the lifting unit is completed, thereby preventing the drawer from colliding with other doors.

Still another objective of the present disclosure is to provide a refrigerator and a control method therefor in which reopening of the drawer, detecting of opening completion of the drawer, and lowering of the lifting unit proceed automatically in a consecutive manner when the drawer is closed in a state where the lifting unit is being elevated or the elevation of the lifting unit is completed.

A further objective of the present disclosure is to provide a refrigerator and a control method therefor in which, when it is detected that the drawer is closed in a state where the lifting unit is being elevated or the elevation of the lifting unit is completed, the drawer is restrained from being closed to prevent the drawer from colliding with other doors and then the drawer is released to be closed.

Still another objective of the present disclosure is to provide a refrigerator and a control method therefor in which the elevation of the lifting unit and the opening and closing of the drawer are performed smoothly and stably.

Still another objective of the present disclosure is to provide a refrigerator and a control method therefor in which the drawer is fully opened when it is detected that the drawer is closed in a state where the lifting unit is being elevated or the elevation of the lifting unit is completed.

Another objective of the present disclosure is to provide a refrigerator and a control method therefor in which, when it is detected that the drawer is closed in a state where the lifting unit is being elevated or the elevation of the lifting unit is completed and thus the drawer is opened, a notification of opening of the drawer is shown on a display or output in the form of sound.

A further objective of the present disclosure is to provide a refrigerator and a control method therefor in which the drawer is opened without any additional user manipulation input when it is detected the drawer is closed in a state where the lifting unit is being elevated or the elevation of the lifting unit is completed.

The above-mentioned objectives of the present disclosure may not be limited only to the objectives described above. Accordingly, additional objectives of the present disclosure will be set forth in part in the description which follows and in part will become apparent to those having ordinary skill in the art upon examination of the following or may be learned from practice of the present disclosure.

A control method for a refrigerator according to an embodiment of the present disclosure includes opening a drawer according to a user manipulation input; and reopening the drawer when the drawer starts to be closed while a lifting unit is being elevated or the elevation of the lifting unit is completed.

When the drawer starts to be closed while the lifting unit is being elevated or the elevation of the lifting unit is completed, the closing of the drawer may be detected and the drawer may be restrained from being closed.

When the drawer is restrained from being closed, the drawer may be released to reopen the drawer.

When opening the drawer, the drawer may be fully opened (to an opening completion position).

After the drawer is opened, the lifting unit (or lifting mechanism) may be lowered immediately.

After the lifting unit is lowered, the drawer may be closed immediately.

When the drawer is reopened, a notification of the reopening of the drawer may be shown on a display or output through a speaker in the form of sound.

When the closing of the drawer is detected while the lifting unit is being elevated or the elevation of the lifting unit is completed, the drawer is opened without any additional user manipulation to quickly prevent a safety accident.

A control method for a refrigerator according to another embodiment of the present disclosure includes: checking a state of a lifting unit by a controller while the refrigerator operates; fully reopening the drawer when it is detected that the drawer starts to be closed while the lifting unit is being elevated or the elevation is completed; and lowering the lifting unit after the drawer is fully reopened.

The drawer may be opened until an opening completion sensor detects that the opening of the drawer is completed.

A refrigerator according to an embodiment of the present disclosure includes: a cabinet providing an upper storage space and a lower storage space; a drawer provided to move in and out of the lower storage space and opening and closing the lower storage space; a lifting unit provided inside the drawer and elevated up and down; an opening/closing motor providing power for opening and closing the drawer; a lifting motor connected to the lifting unit and providing power for elevating the lifting unit; a manipulation unit where a manipulation of a user is input to operate the drawer; and a controller electrically connected to the manipulation unit, the opening/closing motor, and the lifting motor. The controller reopens the drawer when the closing of the drawer is detected while the lifting unit is being elevated or the elevation of the lifting unit is completed.

The controller may operate the opening/closing motor in a direction opening the drawer to reopen the drawer. The controller may operate the opening/closing motor until the reopening of the drawer is completed.

The controller may allow the lifting unit to be lowered when it is detected that the opening of the drawer is completed due to the reopening of the drawer. The controller may operate the opening/closing motor to close the drawer when it is detected that the lowering of the lifting unit is completed.

The controller may reopen the drawer without any additional user manipulation input to the manipulation unit when the closing of the drawer is detected while the lifting unit is being elevated or the elevation of the lifting unit is completed.

The refrigerator and the control method therefor according to the present disclosure may have the following effects.

According to the present disclosure, the drawer is configured to be automatically opened and closed and configured such that a storage bin inside the drawer is partly raised while the drawer is opened, so a user does not need to excessively bend over to store food inside the drawer disposed below, which means ease of use is improved.

According to the present disclosure, the drawer is configured such that the storage bin inside the drawer is partly raised while the drawer is opened. Therefore, a user does not need to excessively bend over to store food inside the drawer disposed below, which means ease of use is remarkably improved.

According to the present disclosure, a lifting sensor detecting whether elevation of a lifting unit is completed is provided so that an operation state of the lifting unit can be determined accurately.

The lifting sensor is provided in a front panel, and the elevation state of the lifting unit can be determined through operation of a driving unit. Therefore, it is possible to accurately determine the elevation state of the lifting unit without providing any electrical device in a drawer part.

According to the present disclosure, whether the elevation and lowering of the lifting unit is completed is determined accurately, thereby preventing inconvenience in use caused by malfunction of the lifting unit or preventing a safety accident.

According to the present disclosure, even when the drawer is closed from a state where the drawer is open and the lifting unit is being elevated or the elevation of the lifting unit is completed, the drawer can be quickly reopened to prevent the lifting unit from colliding with adjacent doors.

According to the present disclosure, even when the drawer is closed in a state where the lifting unit is being elevated or the elevation of the lifting unit is completed, the drawer is fully and quickly opened, thereby ensuring the safety of use.

According to the present disclosure, when the drawer is closed in a state where the lifting unit is being elevated or the elevation of the lifting unit is completed, the drawer is fully opened and then the lifting unit is lowered to fully close the drawer, thereby preventing an additional safety accident and the temperature rise in the refrigerator.

According to the present disclosure, when the drawer is closed in a state where the lifting unit is being elevated or the elevation of the lifting unit is completed, the drawer is opened automatically without any additional user manipulation input, thereby quickly preventing collision of the lifting unit.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

This application is also related to U.S. application Ser. No. 16/583,726 filed Sep. 26, 2019, U.S. application Ser. No. 16/582,647 filed Sep. 25, 2019, U.S. application Ser. No. 16/582,518 filed Sep. 25, 2019, U.S. application Ser. No. 16/582,605 filed Sep. 25, 2019, U.S. application Ser. No. 16/582,712 filed Sep. 25, 2019, U.S. application Ser. No. 16/582,756 filed Sep. 25, 2019, U.S. application Ser. No. 16/582,810 filed Sep. 25, 2019, U.S. application Ser. No. 16/582,668 filed Sep. 25, 2019, U.S. application Ser. No. 16/582,755 filed Sep. 25, 2019, U.S. application Ser. No. 16/582,831 filed Sep. 25, 2019, U.S. application Ser. No. 16/585,301 filed Sep. 27, 2019, and U.S. application Ser. No. 16/585,816 filed Sep. 27, 2019, whose entire disclosures are also hereby incorporated by reference.

What is claimed is:

1. A method for controlling a refrigerator, the method comprising:

receiving an input of a user;

moving a drawer to open a storage space of the refrigerator by a first operation of a first motor, based on the received input;

raising a portion of a lifting mechanism provided in the drawer to a set height by a first operation of a second motor when a first sensor detects that the drawer has moved to an opening completion position;

ending the first operation of the second motor when a second sensor detects elevation completion of the portion of the lifting mechanism based on the portion of the lifting mechanism being positioned at the set height;

reopening the drawer by a second operation of the first motor when the first sensor detects that the drawer starts to be closed from the opening completion position while the second sensor detects the elevation completion of the portion of the lifting mechanism; and lowering the portion of the lifting mechanism by a second operation of the second motor when the first sensor detects that reopening of the drawer by the second operation is completed.

2. The method of claim 1, wherein the reopening of the drawer by the second operation, the detecting of reopening completion of the drawer, and the lowering of the portion of the lifting mechanism proceed consecutively.

3. The method of claim 1, further comprising:

closing the drawer after the lowering of the portion of the lifting mechanism, in which the first motor operates to close the drawer when the second sensor detects that the lowering of the portion of the lifting mechanism is completed.

4. The method of claim 3, wherein, when the second sensor detects that the lowering of the portion of the lifting mechanism is completed, the second operation of the second motor is stopped, and the first motor is to close the drawer.

5. The method of claim 4, wherein the second operation of the second motor and the closing of the drawer by the first motor proceed consecutively.

6. The method of claim 1, wherein the reopening of the drawer includes restraining the drawer when the first sensor detects that the drawer starts to be closed from the opening completion position.

7. The method of claim 6, whereinafter the drawer is restrained from being closed, the drawer is released and the second operation of the first motor is to reopen the drawer toward the opening completion position.

8. The method of claim 1, wherein the reopening of the drawer includes reopening the drawer until the first sensor detects that the drawer has reached the opening completion position.

9. The method of claim 1, wherein the reopening of the drawer includes outputting a notification of the reopening of the drawer.

10. The method of claim 9, wherein the notification of the reopening of the drawer is shown on a display or is output through a speaker.

11. The method of claim 1, wherein the reopening of the drawer includes operating the first motor without any additional user manipulation input when the first sensor detects that the drawer starts to be closed.

12. A refrigerator, comprising:

a cabinet to provide an upper storage space and a lower storage space;

a drawer to move to open and close an opening of the lower storage space;

a lifting mechanism provided inside the drawer to move up and down;

a first motor that provides a force to move the drawer;

a second motor connected to the lifting mechanism, the second motor configured to provide a force to move a portion of the lifting mechanism;

a user input device to receive a command from a user; and a controller configured to open the drawer and to close the drawer; wherein the controller is configured to reopen the drawer when the closing of the drawer is detected while the portion of the lifting mechanism is being elevated or elevation of the portion of the lifting mechanism is completed.

13. The refrigerator of claim 12, wherein the controller is configured to operate the first motor such that the drawer is to reopen in a direction toward an opening completion position.

14. The refrigerator of claim 13, wherein the controller is configured to control the first motor until the reopening of the drawer is completed.

15. The refrigerator of claim 14, wherein the controller is configured to control the portion of the lifting mechanism to be lowered when the reopening of the drawer is completed.

16. The refrigerator of claim 15, wherein the controller is configured to control the first motor to close the drawer when the lowering of the portion of the lifting mechanism is determined to be completed.

17. The refrigerator of claim 12, wherein the controller is configured to reopen the drawer without any additional user manipulation input when the closing of the drawer is detected while the portion of the lifting mechanism is being elevated or elevation of the portion of the lifting mechanism is completed.

* * * * *